US011655807B2

(12) United States Patent
Fisher et al.

(10) Patent No.: US 11,655,807 B2
(45) Date of Patent: May 23, 2023

(54) DISTRIBUTED IN-FIELD POWERED PUMPING CONFIGURATION

(71) Applicant: Halliburton Energy Services, Inc., Houston, TX (US)

(72) Inventors: Chad Adam Fisher, Cache, OK (US); Wesley John Warren, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/084,214

(22) Filed: Oct. 29, 2020

(65) Prior Publication Data

US 2022/0136489 A1 May 5, 2022

(51) Int. Cl.

| | |
|---|---|
| ***F04B 23/04*** | (2006.01) |
| ***F04B 17/03*** | (2006.01) |
| ***F04B 15/02*** | (2006.01) |

(52) U.S. Cl.

CPC ..... *F04B 23/04* (2013.01); *F04B 15/02* (2013.01); *F04B 17/03* (2013.01)

(58) Field of Classification Search

CPC ..... F04B 15/00; F04B 15/02; F04B 17/00; F04B 17/03; F04B 17/05; F04B 17/06; F04B 23/00; F04B 23/02; F04B 23/025; F04B 23/028; F04B 23/04; F04B 23/06; F04B 23/08; F04B 23/10; F04B 23/12; F04B 23/14; E21B 43/00; E21B 43/12; E21B 43/16; E21B 43/162; E21B 43/17; E21B 43/25; E21B 43/26; E21B 43/2607

USPC ..... 166/177.5, 308.1

See application file for complete search history.

(56) References Cited

U.S. PATENT DOCUMENTS

| | | | | |
|---|---|---|---|---|
| 7,841,394 | B2 | 11/2010 | McNeel | |
| 8,834,012 | B2 | 9/2014 | Case et al. | |
| 9,970,278 | B2 | 5/2018 | Broussard et al. | |
| 2007/0201305 | A1 * | 8/2007 | Heilman | E21B 43/267 366/141 |

(Continued)

FOREIGN PATENT DOCUMENTS

| | | | |
|---|---|---|---|
| WO | 2009095482 | A2 | 8/2009 |
| WO | WO-2021247659 | A1 * | 12/2021 |

OTHER PUBLICATIONS

Author: USWS Title: Technology & Innovation Date published (mm/dd/yyyy): Feb. 15, 2020 Date accessed (mm/dd/yyyy): Mar. 9, 2023. Link: https://web.archive.org/web/20200215114341/http:/uswellservices.com:80/technology/ (Year: 2020).*

*Primary Examiner* — Charles G Freay
*Assistant Examiner* — Chirag Jariwala
(74) *Attorney, Agent, or Firm* — Conley Rose, P.C.; Rodney B. Carroll

(57) ABSTRACT

An in-field powered distributed pumping system and method are provided. The system includes a pump unit disposed at a first location and a slurry pump unit disposed at a second location. The system also includes at least one grid power supply, wherein at least one of the pump unit and the slurry pump unit is powered by the at least one grid power supply. The system further includes a first flow path fluidly connected to the pump unit at the first location and configured to fluidly connect the pump unit to a well bore, and a second flow path fluidly connected to the slurry pump at the second location and configured to fluidly connect the slurry pump unit to the well bore.

20 Claims, 9 Drawing Sheets

(56) References Cited

U.S. PATENT DOCUMENTS

| | | | | |
|---|---|---|---|---|
| 2007/0277982 | A1* | 12/2007 | Shampine | E21B 43/16 166/308.1 |
| 2008/0029267 | A1* | 2/2008 | Shampine | E21B 43/25 166/305.1 |
| 2009/0301725 | A1* | 12/2009 | Case | E21B 43/267 166/308.1 |
| 2013/0112419 | A1* | 5/2013 | DeFosse | E21B 43/26 166/308.1 |
| 2016/0230525 | A1* | 8/2016 | Lestz | E21B 43/267 |
| 2018/0156210 | A1* | 6/2018 | Oehring | H02J 3/38 |
| 2018/0187536 | A1* | 7/2018 | Hefley | B01F 25/314 |
| 2018/0298731 | A1* | 10/2018 | Bishop | H02J 3/381 |
| 2018/0363434 | A1 | 12/2018 | Coli et al. | |
| 2019/0316456 | A1* | 10/2019 | Beisel | F04B 49/06 |
| 2020/0263528 | A1* | 8/2020 | Fischer | E21B 43/2605 |
| 2020/0300073 | A1* | 9/2020 | Hinderliter | E21B 43/26 |
| 2021/0310341 | A1* | 10/2021 | Sherman | F04B 47/00 |

* cited by examiner

DISTRIBUTED IN-FIELD POWERED PUMPING CONFIGURATION

BACKGROUND

The present disclosure relates generally to well treatment operations and, more particularly, to distributed in-field powered pumping configurations for performing well treatment operations.

Hydrocarbons, such as oil and gas, are commonly obtained from subterranean formations that may be located onshore or offshore. The development of subterranean operations and the processes involved in removing hydrocarbons from a subterranean formation are complex. Subterranean operations involve a number of different steps such as, for example, drilling a wellbore at a desired well site, treating and stimulating the wellbore to optimize production of hydrocarbons, and performing the necessary steps to produce and process the hydrocarbons from the subterranean formation.

Treating and stimulating a well bore can include, among other things, delivering various fluids (along with additives, proppants, polymers, gels, cement, etc.) to the wellbore under pressure and injecting those fluids into the wellbore. One example treatment and stimulation operation is a hydraulic fracturing operation in which the fluids are highly pressurized via pumping systems to create fractures in the subterranean formation. The pumping systems typically include high-pressure, reciprocating pumps driven through conventional transmissions by diesel engines, which are used due to their ability to provide high torque to the pumps. Over the course of a fracturing operation, however, the diesel engines may consume thousands of gallons of diesel fuel, which is expensive and can be difficult to supply in sufficient quantities in a well site. Electrically powered pumping systems are of increasing interest for well treatment operations. However, the potential to use an electrical grid to power well treatment operations is limited due to the cost associated with installing in-field grid infrastructure that can support the high horsepower pumping systems.

BRIEF DESCRIPTION OF THE DRAWINGS

These drawings illustrate certain aspects of some of the embodiments of the present disclosure, and should not be used to limit or define the claims.

Figure 1:
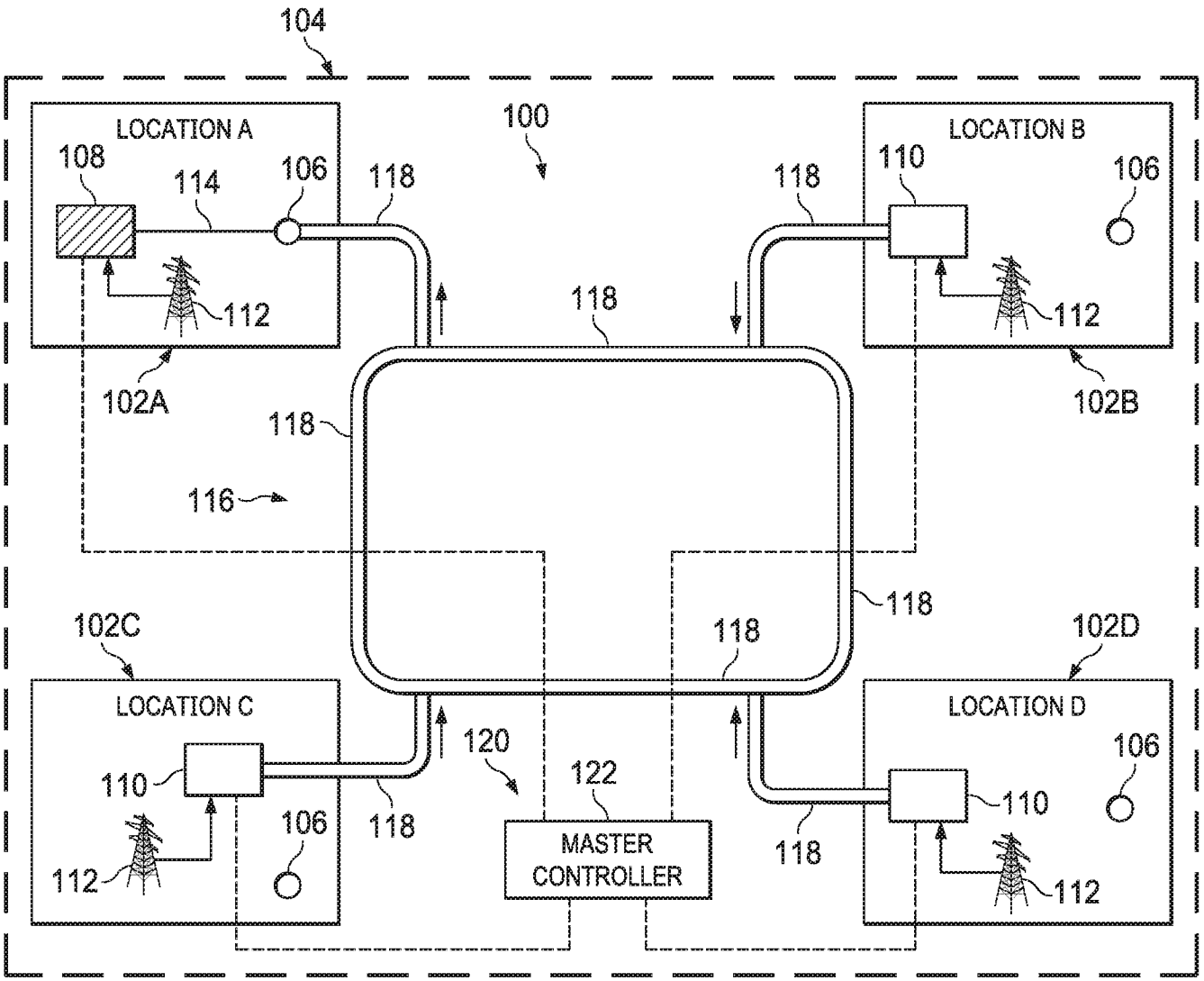
FIG. 1 is a schematic block diagram of a distributed pumping system having a slurry equipment spread and three clean equipment spreads distributed in series about four locations in a well field, in accordance with an embodiment of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The present disclosure is directed to distributed in-field powered systems and methods for performing well treatments. The term "distributed in-field powered" or "grid powered" refers to electrical power that is being distributed throughout a field in which the power is being used to power equipment, e.g., distributed pumping units. Such power may include remote utility grid power provided by a utility company or power that is generated on-site and distributed throughout the field. The "distributed in-field power" will be referred to generally as "grid power" throughout the present disclosure. The disclosed systems and methods distribute the pumping for a well treatment operation, which may be a stimulation operation, amongst multiple locations within a well region or field to reduce the cost of distributed in-field (e.g., grid) power infrastructure required at each location. The systems and methods involve pump units distributed at multiple locations and at least some of the pump units using grid power at their location to pump a well treatment to a singular well. This splits the power requirements for the pump units between the multiple locations. This allows for the power grid to be distributed throughout the field at power levels lower than that required if all treatment equipment were located at a single location.

The well treatment operation may be performed in a split flow manner with slurry blending and slurry pumping equipment located at one location, such as the location (i.e., well site or pad) of the well being treated and one or more clean pumps distributed amongst other location(s). In other embodiments, the well treatment operation may utilize clean pumping equipment located at the location (i.e., well site or pad) of the well being treated and at least one set of slurry blending and slurry pumping equipment at other location(s). In still other embodiments, slurry blending and slurry pumping equipment may be located at all the distributed pumping locations. In still further embodiments, only clean pumping equipment may be located at each of the distributed pumping locations. In some embodiments, the distributed pumping equipment spreads may each be located distant from the well being treated with their combined treatment fluid.

Placing the slurry equipment at the location of the well being treated may minimize high-pressure iron exposure to erosive slurries. In addition, using only clean fluid at locations remote from the location of the well being treated may allow for high fluid velocities with minimal high-pressure iron erosion. Using the disclosed distributed pumping systems, slurry blending and pumping equipment may be relocated to different distributed pumping locations between pumping operations. For example, slurry blending and pumping equipment may be relocated from an initial location once all wells at the location (e.g., all wells on a given pad) are treated. In other embodiments, the slurry blending and pumping equipment may remain stationary throughout pumping operations. The clean pump units may only need to be relocated when they are being displaced by slurry equipment. In other embodiments, the clean pump units may remain stationary throughout pumping operations.

The disclosed grid powered distributed pumping systems and methods may enable well treatments to be completed across a well region. The systems and methods facilitate fully grid powered well treatment operations (including well stimulations) without requiring large amounts of power (e.g., 30,000 kW) to be delivered to each location. Since less power is required to be delivered to each location using the disclosed distributed pumping systems, the grid infrastructure may include smaller power lines run to one or more locations than would be needed to power a full stimulation operation at one location. Since a smaller amount of power is delivered to one or more locations in the region, the same grid infrastructure may be used at a given well location throughout the different stages of well development. For example, the grid infrastructure used for the distributed pumping systems may also be used to power drilling equipment used to drill the well, cementing equipment used to cement the well, production equipment used to produce the well, or a combination thereof. As such, there is no need to replace power lines at different points during the life cycle of a given well, and the grid infrastructure may be a permanent one-time installation. Thus, a permanent one-time installation of grid infrastructure at a region may provide power to operate components used throughout the full life of a well, including drilling, cementing, well treatments (e.g., stimulation), and production, reducing capital cost of infield grid power and/or grid infrastructure on location.

The grid powered distributed pumping systems and methods may expand the use of grid power in well stimulation operations. This may reduce fuel costs since Diesel powered pump units can be eliminated at one or more locations. In addition, the use of grid power may provide increased reliability while requiring less maintenance compared to systems that generate electrical power via a turbine generator at a fracturing spread. In addition, instead of concentrating equipment at a singular power source, the equipment is distributed among multiple power sources to better match power demand with available power at each location.

Turning now to the drawings, FIG. 1 illustrates a grid powered distributed pumping system 100 in accordance with an embodiment of the present disclosure. The pumping system 100 of FIG. 1 is distributed about four different locations 102A, 102B, 102C, and 102D within a region 104 where well treatment operation(s) are performed. In the illustrated embodiment, each location 102 is a well pad or wellsite. That is, at least one subterranean wellbore 106 is formed at each location 102. In other embodiments, at least one of the locations 102 in which the distributed pumping system 100 is provided may not include a subterranean wellbore. Such locations 102 having no wellbores may include an infield utility station, a gas compressor station, an oil or water tank battery site, a field equipment service area, an electrical substation, or another site.

The distributed pumping system 100 may include at least one slurry pumping equipment spread 108 and at least one clean pumping equipment spread 110, the slurry pumping equipment spread 108 and clean pumping equipment spread 110 being disposed at different locations 102. The illustrated embodiment includes, for example, one slurry equipment spread 108 disposed at location 102A and three clean pumping equipment spreads 110 disposed one at each of locations 102B, 102C, and 102D. However, in other embodiments, different numbers and combinations of slurry pumping equipment spreads 108 and/or clean pumping equipment spreads 110 may be provided at locations 102 throughout the region 104. In some embodiments, the distributed pumping system 100 may include a single slurry pumping equipment spread 108, while all other pumping equipment spreads in the distributed pumping system 100 are clean pumping equipment spreads 110. In other embodiments, the distributed pumping system 100 may include multiple slurry pumping equipment spreads 108 for redundancy. In still other embodiments, the distributed pumping system 100 may include all slurry pumping equipment spreads 108 distributed throughout the field without any clean pumping equipment spreads 110.

The slurry pumping equipment spread 108 may include, among other things, at least one slurry pump unit, while the clean pumping equipment spread 110 may include, among other things, at least one clean pump unit. The distributed pumping system 100 may be entirely grid operated. As such, each location 102 in which the pump units are distributed may include grid infrastructure (e.g., a grid power supply) 112 electrically coupled to the associated pumping equipment spread (108 or 110) at the location 102. As such, at the location 102A the slurry pumping equipment spread 108 may be powered by grid power from the grid infrastructure 112 at the location 102A. Similarly, the clean pumping equipment spreads 110 at each of the locations 102B, 102C, and 102D may be powered by grid power from the grid infrastructure 112 at the locations 102B, 102C, and 102D, respectively. In other embodiments, the distributed pumping system 100 may be powered by a combination of grid infrastructure 112 and power generated at the site by a diesel engine, a turbine generator, a dual-fuel powered system, fuel cells, or a combination thereof. For example, one or more locations may be equipped with grid infrastructure 112 to provide grid power for operating the pumping equipment spread(s) at the locations, while one or more other locations may be equipped with power generation equipment for operating the pumping equipment spread(s) at those other locations.

The term slurry pumping equipment spread 108 refers to equipment used to at least pressurize a slurry of at least one base fluid mixed with solids and/or polymers. Such equipment includes at least one pump unit (also referred to as a "slurry pump unit"). In some embodiments, the slurry pumping equipment spread 108 may also include equipment used to generate the slurry. Such equipment may include, for example, solid material handling equipment (e.g., proppant handling equipment), fluid handling equipment, polymer handling equipment, a blender, and so forth. The slurry pumping equipment spread 108 may be coupled to at least one wellbore 106 at the location 102 thereof via a high-pressure manifold 114 (or high-pressure iron). The high-pressure manifold 114 forms at least a portion of a flow path from the slurry pumping equipment spread 108 to the at least one wellbore 106. In other embodiments, as discussed below, the slurry pumping equipment spread 108 may be coupled to at least one wellbore 106 at a different location in the region 104 via a flow path.

The term clean pumping equipment spread 110 refers to equipment used to at least pressurize a "clean" fluid, meaning a fluid containing minimal or no solids. In some embodiments, the "clean" fluid may contain polymers, for example, such as friction reducers. In other embodiments, the "clean" fluid may contain minimal or no polymers as well as minimal or no solids. The clean pumping equipment spread includes at least one pump unit (also referred to as a "clean pump unit"). In some embodiments, the clean pumping equipment spread 110 may also include one or more of a clean fluid source, a chemical injection equipment, and so forth. Each clean pumping equipment spread 110 and/or slurry pumping equipment spread 108 may tie into a piping network 116 distributed throughout the region 104. This piping network 116 may include one or more flow paths used to route clean fluid from one or more of the clean pumping equipment spreads 110 to a well site (e.g., location 102A) within the region 104. The piping network 116 may fluidly connect each location 102B, 102C, and 102D having clean pumping equipment spreads 110 to the location 102A having the slurry pumping equipment spread 108. In some embodiments, the piping network 116 may fluidly connect each clean pumping equipment spread 110 to every location 102A, 102B, 102C, and 102D with a subterranean wellbore 106. That way, the clean pumping equipment spreads 110 may tie into the piping network 116 that can route clean fluid to any well sites within the distributed pumping system 100.

The piping network 116 may include a network of lengths of pipe (or flow paths) 118 connecting the clean pumping equipment spreads 110 to other locations in the region 104. In some embodiments, the piping network 116 may also include one or more flow paths 118 connecting one or more slurry equipment spreads 108 to other locations in the region 104. Each length of pipe 118 may include valving thereon that facilitates flow in either direction or both directions through the piping network 116. For example, each length of pipe 118 may be equipped with valving that is controllable to selectively allow flow through the length of pipe 118 in a first direction, a second direction opposite the first direction, or in either direction depending on fluid pressures in the piping network 116. The valving in the piping network 116 may enable any one of the lengths of pipe 118 to be closed off without interrupting pumping. This may be useful for isolating a length of pipe 118 for leak repair or other maintenance throughout pumping operations. In other embodiments, one or more lengths of pipe 118 may not include valving thereon, but rather simply enable bidirectional flow depending on fluid pressures in the piping network 16.

In the illustrated embodiment of FIG. 1, the distributed pumping system 100 is spread amongst four locations 102 in the region 104. However, the distributed pumping system 100 may be spread amongst any number of locations 102 totaling two or more. For example, the distributed pumping system 100 may include pumping equipment spread amongst two, three, four, five, six, seven, eight, nine, ten, eleven, twelve, or more locations 102 in the region 104. The number of locations 102 in which the distributed pump units are disposed may be selected based on the power needs for different operations being performed at the well sites within the region 104. The locations 102 may be separate and spread apart from each other. The locations 102 at which the different pump units are disposed may each be spaced a distance apart from each other location 102. For example, each locations 102 may be a distance of between approximately 50 yards and approximately 5 miles from each other location 102, and more particularly a distance of between approximately 100 yards and 2 miles from each other location 102.

To perform well treatments, the slurry pumping equipment spread 108 pressurizes a slurry including a fluid base with particles of solid and/or polymer disposed therein and outputs the pressurized slurry flow to one or more wellbores 106 at the location 102A. At the same time, one or more clean pumping spreads 110 may be used to pressurize clean fluid from the remote locations 102B, 102C, and/or 102D, and the piping network 116 may route the pressurized clean fluid to the location (e.g., location 102A) at which the well(s) are being treated. The pressurized clean fluid flow(s) are combined with the pressurized slurry at the location of the well(s) to form a well treatment fluid that is pumped down the well bore(s) 106. In some embodiments, the combined well treatment fluid may be pumped down multiple well bores simultaneously. The clean pump unit(s) of the clean pumping spreads 110 function to supply dilution fluid that increases the overall fluid rate and decreases the concentration of solids in the slurry to form the desired treatment fluid communicated downhole.

The disclosed distributed pumping system 100 may be used to perform well treatments (e.g., stimulation operations) at a plurality of well sites (e.g., locations 102) in the region 104 with minimal movement of pumping equipment. The distributed configuration of pump equipment in the region 104 may enable easy switching from performing treatments on one well site (e.g., location 102A) to another (e.g., location 102B). During well treatment operations, the slurry pumping equipment spread 108 may be disposed at a location 102 local to the wellbore being treated. For example, in the configuration of FIG. 1, the slurry pumping equipment spread 108 is located at location 102A as one or more wellbores 106 disposed at or proximate the location 102A are being treated. That way, exposure of piping to the abrasive slurry is limited to the high-pressure manifold 114 at the location 102A. The equipment of the distributed pumping system 100 may remain in this configuration until all wells disposed at or proximate the location 102A are treated and/or completed. After this, the slurry pumping equipment spread 108 may be traded with one of the clean pumping equipment spreads 110 to facilitate treatment operations at another location 102 in the region 104. In other embodiments, only a portion of the slurry pumping equipment spread 108 (e.g., solids handling equipment, gel handling equipment, blender equipment, etc.) may be moved from one site to another, while the pump units stay at their original locations. In such embodiments, fewer pieces of equipment would need to be moved when switching between different sites for well treatment.

The compositions discharged by the pump unit(s) of the slurry pumping equipment spread 108 may include one or more components, including without limitation one or more base fluids, one or more gasses, one or more liquids, one or more solids, and any combination thereof that may be used in accordance with the methods of the present disclosure. The pump unit(s) of the slurry pumping equipment spread 108 may intake and discharge compositions including solids, or abrasive or corrosive materials, such that these pump unit(s) may experience more wear and tear than the pump unit(s) of the clean pumping equipment spread(s) 110 and may therefore require protective coatings that prevent and resist abrasion, erosion, and corrosion.

The pump unit(s) of the clean pumping equipment spread(s) 110 may not be exposed to the same components and may not require protective coatings and may experience less wear and tear. Similarly, the pump unit(s) of the clean pumping equipment spread(s) 110 may be replaced less frequently than the pump unit(s) of the slurry pumping equipment spread 108, resulting in lower costs and less down time. Accordingly, the pump unit(s) of the clean pumping equipment spread(s) 110 may require less maintenance or may cost less than the pump unit(s) of the slurry pumping equipment spread 108, which may save costs and enable more efficient and effective operations.

In addition, since the clean pumping equipment spread(s) 110 are used to pump clean fluid having few or no abrasive components therein, it is possible to locate the clean pumping equipment spread(s) 110 away from the slurry pumping equipment spread 108. The clean pumping equipment spread(s) 110 can effectively and efficiently pump the clean fluid over longer distances through the piping network 116 than may be possible if they were pumping slurry. In addition, the requirements of the junctions throughout the piping network 116 may not require protective coatings or specific designs to minimize wear and tear since only clean fluid is being pumped therethrough. Accordingly, the piping network 116 coupling the pump unit(s) of the clean pumping equipment spread(s) 110 to the location of the slurry pumping equipment spread 108 (as shown in FIG. 1) may save costs and enable more efficient and effective operations.

The distributed pumping system 100 disclosed herein may include a control system 120 including one or more controllers, wherein each of the controllers may include one or more of hardware elements and software elements. The controller(s) may include consumer off-the-shelf (COTS) computer systems, including hardware and software. The controller(s) may further include specialized hardware and software. The controller(s) may include specialized hardware and software for communicating with one or more of sensors, pumps, blenders, solid storage systems, fluid storage systems, valves, and other elements of the distributed pumping system 100 to monitor (including but not limited to detecting and recording data) and control (including but not limited to regulating, managing, and directing) one or more of the delivery of one or more compositions and one or more treatment fluids for treatment of one or more wells, either independently, simultaneously, or both. The controller(s) may automatically monitor and control the treatment of one or more wells based at least in part on one or more of a reservoir model, a hydraulic fracture model, and programmed fracturing stages. The controller(s) may display or otherwise notify users, including, for example, operations personnel including but not limited to an operator in a control van, regarding the controller's monitoring and controlling of one or more compositions and one or more treatment fluids for treating one or more wells. The controller(s) may receive one or more inputs from personnel to monitor and control one or more of the delivery of one or more compositions and one or more treatment fluids for treating of one or more wells, either independently, simultaneously, or both. One of ordinary skill in the art will further recognize that, as described herein, the one or more compositions and one or more treatment fluids distributed to the well bore 106 at any location 102 (e.g., location 102A) may be distributed to one or more wells at the location 102. As noted herein, the combination of one or more slurry compositions and/or one or more clean fluids to create the one or more treatment fluids may occur prior to delivery to the well bore(s) 106, at the surface of the well bore(s) 106, below ground level after the one or more compositions/fluids are pumped into well bore(s) 106, and any combination thereof.

In some embodiments, the control system 120 of the distributed pumping system 100 may include a master controller 122, pump controllers (not shown), and one or more sensors distributed throughout the pumping system for providing data to the controllers (not shown). The master controller 122 may coordinate some or all elements of the distributed pumping system 100, including without limitation one or more of monitoring and controlling other controllers, pumps, blender(s), fluid storage equipment, solid handling equipment, and gel handling equipment.

The master controller 122 may monitor and communicate with one or more pump controllers to control the pump unit(s) of the slurry pumping equipment spread 108 and the clean pumping equipment spread(s) 110. The pump controllers may be located local to their corresponding pump units. As noted above, the pump controllers may include one or more ordinary computer systems, one or more specialized computer systems, and any combination thereof including hardware and software. In some embodiment, the master controller 122 and pump controllers may be replaced by a distributed control system without a master controller in which each controller coordinates with all other controllers to coordinate the performance of the distributed pumping system 100. In other embodiments, the control system 120 may include a single centralized controller that is communicatively coupled to the distributed pumping equipment and performs the functions of both the master controller 122 and each of the pump controllers from a centralized location or from a location proximate the well treatment location (e.g., 102A in FIG. 1). In still other embodiments, the control system 120 may include one or more controllers located remote from the region 104 in which the distributed pumping system 100 is operating and communicatively coupled to the distributed pumping equipment to perform the functions of both the master controller 122 and each of the pump controllers from the remote location.

The master controller 122 may monitor and control one or more of the types and concentration of components introduced into a blender of the slurry pumping equipment spread 108 to produce one or more compositions, as well as the component concentration and flow rate of composition from the blender. The master controller 122 may also monitor and control one or more of the types, flow rates, pressure, and output power of fluids pumped by the pump units of the clean pumping equipment spread(s) 110. The master controller 122 may control valving, pumping systems, and other systems related to the clean pump units. The master controller 122 may monitor and/or control solid storage, fluid storage, and solid handling systems to ensure sufficient component material and fluids are available for the pumping equipment spreads 108 and 110. Further, the pump controllers may monitor and control the mixing of compositions to control the production of one or more treatment fluids based on data from one or more pumps, sensors, and other elements of the distributed pumping system.

The master controller 122 may monitor and control the output flow rates or pumping pressures of each pump unit within the slurry pumping equipment spread 108 and the clean pumping equipment spread(s) 110. The master controller 122 may control the operation of each pump unit within the slurry pumping equipment spread 108 and the clean pumping equipment spread(s) 110. For example, the master controller 122 may output signals to turn on certain pump units and turn off other pump units to output the desired treatment fluid at a desired concentration and pressure to the well(s) being treated. The master controller 122 may modify the operation of any pump units in the slurry or clean pumping equipment spreads 108, 110 to dynamically control the treatment of the well(s). In some embodiments, the master controller 122 may determine which pump units in the region 104 to operate at the same time to provide the desired well treatment based on the power available through grid infrastructure or other power sources at the locations 102 throughout the region 104. In this way, the master controller 122 may operate different pump units of the slurry pumping equipment spread 108 and the clean pumping equipment spread(s) 110 at different times to balance the power used at the different locations 102 in the region 104. In some embodiments, the master controller 122 may determine which pump units in the region 104 to operate at the same time to provide the desired well treatment based on a pump maintenance schedule or sensor feedback indicating that maintenance is needed at one or more pump units. For example, when maintenance is scheduled or needed for one or more pump units at one location 102, the master controller 122 may change operation of the pump unit(s) so that the pump unit(s) needing maintenance are taken offline and pump unit(s) at the same location or another location are brought online as needed to satisfy the well treatment pumping requirements.

One or more pump controllers may interact with sensors associated with their associated pump units. Sensors may be integrated into one or more pump units of the slurry or clean pumping equipment spreads 108, 110 or may be separate devices. The sensors may provide data including but not limited to the injection pressure, injection rate, flow rate, composition, temperature, and density of slurry or fluid discharged by a pump. The pump controllers may monitor sensor data from their associated pump units. The pump controllers may also control their associated pumps based at least in part on the monitored sensor data and may communicate sensor data and control data to the master controller 122. Similarly, the master controller 122 may monitor sensor data provided by the pump controllers and may provide instructions to the pump controllers based at least in part on sensor data and control data to control one or more of the injection pressure, injection rate, flow rate, and composition of treatment fluid handled by the pump units. The master controller 122 may also monitor one or more of the time rate of change and integrated value of sensor data and control parameters.

In one or more embodiments, the master controller 122 may monitor and provide notifications to personnel when one or more sensors indicate significant wear and tear to equipment to ensure equipment is replaced before a significant reduction in performance of the equipment occurs.

The disclosed distributed pumping system 100 may provide several advantages, including a reduction in stimulation pad size at each site (e.g., well site) in the region 104. Since the pumping equipment spreads 108, 110 are spread out among different locations 102, a smaller number of pump units are required at each location 102 compared to equipment spreads that are not distributed. Accordingly, the footprint of each equipment spread 108, 110 is less than a footprint of a non-distributed pumping equipment spread. In addition, in embodiments where the distributed pumping system 100 use grid power at each location 102 to operate the pump units, there is no need for large power generation equipment (e.g., turbine generator) at the locations 102. This further reduces the footprint of the pumping equipment spreads 108, 110 compared to other pumping systems that run on electrical power.

Figure 2:
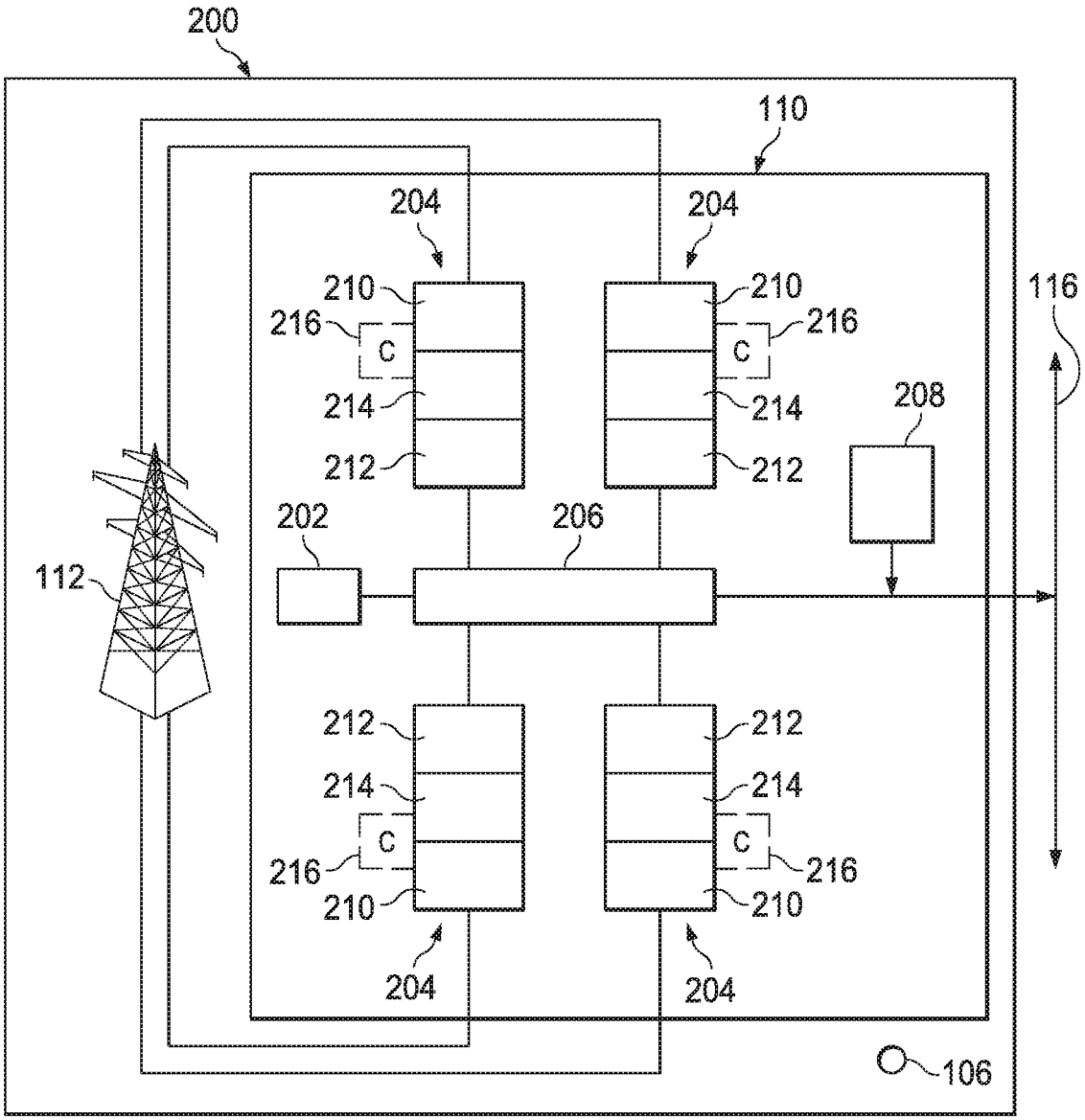
FIG. 2 is a schematic block diagram of a clean equipment spread, in accordance with an embodiment of the present disclosure.

Having described the general layout of a distributed pumping system 100 in accordance with an embodiment of the present disclosure, a more detailed description of the equipment that makes up a clean pumping equipment spread 110 will now be provided. FIG. 2 illustrates an embodiment of the equipment that may be disposed at a clean location 200. The term "clean location" 200 refers to any location (e.g., 102B, 102C, and 102D of FIG. 1) at which a clean pumping equipment spread 110 is currently located. As any of the clean pumping equipment spread(s) 110 may be moved throughout the course of treating wells at different locations throughout a region, the location itself may later become a "slurry location" and/or a well treatment location in which a well at the location is being treated. Although the clean pumping equipment spread 110 may be moved from the location, the corresponding grid infrastructure 112 will remain in place at the location.

As shown in FIG. 2, the clean location 200 may include, among other things, the clean equipment spread 110 and a grid power supply 112. In some embodiments, the clean location 200 may also include one or more subterranean wellbores 106 as well. In other embodiments, though, the clean location 200 may be at a location other than a wellsite in the region. For example, the clean location 200 may be at a utility station or anywhere else in the well region (e.g., 104 of FIG. 1) without a wellbore. The clean equipment spread 110 may include, among other things, fluid handling equipment 202, at least one pump unit 204, and a manifold 206 coupling the fluid source 202 and pumps 204 to the piping network 116. The at least one pump unit 204 may run on electrical power, e.g., from the grid infrastructure 112. In some embodiments, the clean equipment spread 110 may also include chemical injection equipment 208. In some embodiments, the fluid handling equipment 202 may not be movable with the rest of the clean equipment spread 110 but instead remain at the same location throughout different distributed pumping operations.

The grid power supply 112 may include power lines or another connection to an infield power grid or a remote power grid. The term "infield power grid" refers to a power grid that transmits power that is generated in the well region (e.g., 104 of FIG. 1) having the clean location 200. A power generation plant may be built in the region in which several wells are to be drilled, completed, and produced during initial development of the field. Grid infrastructure 112 such as, for example, power transmission lines, are built out from the regional power plant to the various locations (e.g., 102 of FIG. 1) in which pumping and/or other operations are to be performed, including the clean location 200 of FIG. 2, thus forming an infield power grid. The term "remote power grid" refers to a power grid that transmits power that is generated outside of the well region having the clean location 200. For example, during initial development of the well region (e.g., 104 of FIG. 1), the grid power supply 112 on location may be built out from a pre-existing utility power grid that transmits power generated outside the well region.

The grid power supply 112 at the location 200 may supply electrical power sufficient to operate one or more components of the clean equipment spread 110. For example, the amount of power transmitted via the grid power supply 112 may be greater than or equal to an amount sufficient to power one pump unit 204 and less than a total amount of power required to perform the entire well treatment. The amount of power needed to operate one pump unit 204 may be in a range of approximately 1,000 kW to 5,000 kW. A total amount of power required to perform the well treatment may be in a range of approximately 10,000 kW to approximately 40,000 kW. As such, the amount of power provided to the location via the grid power supply 112 may be in a range of greater than 1,000 kW to less than 40,000 kW. In some embodiments, the amount of power transmitted to the clean location 200 via the grid power supply 112 may be an amount in a range of approximately ⅕ to ¼ of the power required to perform the well treatment. As such, the amount of power provided to the location via the grid power supply 112 may be in a range of approximately 2,000 kW to 10,000 kW. In embodiments where the clean location 200 has at least one wellbore 106, the amount of power transmitted to the clean location 200 via the grid power supply 112 may be an amount of electrical power needed for performing other operations at the well, such as drilling operations or production operations. For example, the amount of electrical power sufficient to perform well drilling may be less than approximately 7,500 kW. Less than full grid power is generally sufficient to perform production operations such as powering submersible pumps, compressors, and the like. As such, the amount of power supplied to the location via the grid infrastructure may be in a range of approximately 1,000 kW to 7,500 kW.

Turning now to components of the clean equipment spread 110, the fluid handling equipment 202 may include one or more of a fluid storage system, a fluid communication system, and/or a fluid treatment system. A fluid storage system may include one or more fluid sources in the form of, for example, portable tanks, a ground water source, a pond, or some other fluid retention system. On-location fluid sources may not be movable along with the portable equipment of the clean equipment spread 110. A fluid communication system may include a conduit connecting a remote fluid source to the clean location 200, a conduit connecting the fluid source at the location 200 to the manifold 206, or a combination thereof. A fluid treatment system may include one or more components configured to treat the fluid from a fluid source prior to the fluid entering the one or more pump units 204. Such fluid treatments may include cleaning or removing certain material from the source fluid, and/or mixing one or more additives into the source fluid to produce a clean fluid with a desired fluid characteristic. Other components such as, for example, a boost pump (e.g., centrifugal pump that increases pressure of fluid entering the pump unit inlet) may be included in the fluid handling equipment 202 as will be apparent to a person of ordinary skill in the art. The fluid handling equipment 202 outputs a clean fluid to the manifold 206.

The clean equipment spread 110 may include at least one electrically powered pump unit 204. In the illustrated embodiment, the clean equipment spread 110 includes four electrically powered pumps units 204 manifolded together via the manifold 206. However, other numbers (e.g., one, two, three, five, six, seven, eight, etc.) and arrangements of pump units 204 may be used in other embodiments of the clean equipment spread 110. As illustrated, all the pump units 204 of the clean equipment spread 110 may be electrically powered. It should be noted that, in other embodiments, one or more of the pump units 204 may receive at least part of their operating power from sources other than electrical power or electric grid power. For example, one or more of the pump units 204 may be diesel-, natural gas-, or dual fuel-powered. These pump units 204 operated by non-grid power may be on location and used as back-ups and/or to augment the output of the clean pumping equipment if the grid power is not sufficient to run all of the pumping equipment.

The pump units 204 may each include an electrically powered prime mover 210 and a pump 212. The pump units 204 may each also include a drive train 214. An electrically powered prime mover 210 may include any device or assembly that converts electrical energy into mechanical energy to drive the pump 212. For example, the prime mover 210 may be an electric motor. During pumping operations, the pump 212 may require between approximately 100 hp and 10,000 hp, more particularly between approximately 500 hp and 5,000 hp, from the prime mover 210. In embodiments where one or more pump units 204 at the location are non-grid powered, the one or more non-grid powered pump units 204 may include a prime mover that is powered, for example, by a Diesel, natural gas, or dual-fuel engine to operate a pump.

In some embodiments, the pump 212 may include a reciprocating pump. Reciprocating pumps are often employed for high pressure oilfield pumping applications such as hydraulic fracturing and other treatment operations. Such pumps are sometimes also referred to as plunger pumps or positive displacement pumps. Reciprocating pumps generally include one or more plungers driven by a crankshaft toward and away from a chamber in a pressure housing (referred to as a "fluid end") to create pressure oscillations of high and low pressures in the chamber. These oscillations allow the pump to receive fluid at a low pressure and discharge the fluid at a high pressure via one way valves. In other embodiments, the pump may include a multistage centrifugal pump. Multistage centrifugal pumps generally include an intake pipe that receives fluid at a low pressure, a cylindrical pipe or barrel having a series of impellers or rotors that propel the received fluid, and a discharge pipe that discharges the fluid at a high pressure after the fluid passes through the impellers. As the fluid is propelled by each successive impeller, it gains pressure until it exits the pump at a higher pressure than it entered.

In some embodiments, the pump units 204 of the clean equipment spread 110 may include the same type of pumps (e.g., reciprocating pumps) as used in the slurry equipment spread. In other embodiments, the pump units 204 of the clean equipment spread 110 may include different types of pumps (e.g., multistage centrifugal pumps) as those used in the slurry equipment spread (e.g., reciprocating pumps). The components of multistage centrifugal pumps are subject to generally consistent pressures throughout the operation of the pumps, and therefore are subject to less fatigue and have a longer life expectancy than reciprocating pumps. As such, it may be desirable to use multistage centrifugal pumps in the clean equipment spread(s) 110 of a region having the distributed pumping system, as this may reduce the amount of maintenance needed for the distributed pumping system.

The drive train 214 may be coupled to the prime mover 210 and the pump 212 through one or more drive shafts (not shown), and may include a hydraulic or mechanical transmission that transmits energy from the prime mover 210 to the pump 212. For instance, to the extent the pump 212 is a reciprocating pump, the transmitted energy may include torque that drives the pump 212. In other embodiments, the pump 212 may use a hydraulic transmission such that hydraulic fluid cycles hydraulic cylinders to actuate each plunger in the pump 212.

The fluid handling system 202 may be in fluid communication with the one or more pump units 204 through the manifold 206. The manifold 206 may provide fluid communication between the pump units 204 and the piping network 116 that communicates the pressurized fluid toward the location of the well treatment. Upon the fluid handling system 202 generating a clean fluid, the manifold 206 communicates the clean fluid to the pump units 204 and outputs the pressurized clean fluid from the pump units 204 to the piping network 116. The piping network 116 may direct the pressurized flow of clean fluid from the clean equipment spread 110 toward the location where the treated well bore is located. The pressurized flow of clean fluid may be combined with other pressurized clean fluid flows from other clean equipment spreads in some embodiments. Ultimately, pressurized clean fluid flow(s) from one or more clean equipment spreads is combined with a slurry at the wellsite being treated, enabling the pressurized well treatment operation to be performed on one or more wells at the wellsite. In some embodiments, the slurry may be generated at the wellsite being treated. In other embodiments, the slurry may be pumped from another location to the wellsite being treated, where it is combined with one or more pressurized clean fluid flows.

The manifold 206, connections to the piping network 116, and any other fluid lines included in the clean equipment spread 110 may include valving and one or more sensors for control and monitoring of the flow of clean fluid during distributed pumping operations. A control system of the distributed pumping system may receive signals from sensors and/or output control signals to the valving to control the clean fluid flow output from the system. In some embodiments, the valving may be configured or controlled to facilitate combination of the clean fluid flow output via the manifold 206 with another clean fluid flow being communicated through the piping network from another clean equipment spread in the region. In some embodiments, the valving may be controlled to selectively change the direction in which fluid output from the manifold 206 flows through the piping network 116. In other embodiments, the piping network may extend in only one direction from the manifold 206 such that no valve is needed to direct the flow in a particular direction.

In some embodiments, the clean equipment spread 110 may include chemical injection equipment 208. The chemical injection equipment 208 may be separate from the fluid handling equipment 202 in some embodiments. For example, as illustrated, the chemical injection equipment 208 may inject certain chemical additives (e.g., friction reducers, surfactants, polymers, polymer breakers, diversion additives, corrosion inhibitors, scale inhibitors, clay control agents, pH control additives, and so forth) into the fluid being output from the manifold 206. In other embodiments, the chemical injection equipment 208 may inject one or more chemical additives into the fluid as it enters the manifold 206 or as it is moving through the manifold 206. In other embodiments, the chemical injection equipment 208 may be part of the fluid handling system 202 such that it injects one or more chemical additives into source fluid to generate the fluid output from the fluid handling system 202. Injecting the clean fluid with one or more friction reducers may enable easier communication of the pressurized clean fluid from the clean location 200 to the well treatment location via the piping network 116, particularly in cases where the piping network communicates the clean fluid over relatively long distances across the region.

As illustrated, each of the pump units 204 may be equipped with pump controllers 216 as described above with reference to FIG. 1. These pump controllers 216 may communicate with a master controller (e.g., 122 of FIG. 1) of the distributed pumping system 100. In other embodiments, the pump controllers 216 of the clean equipment spread(s) and slurry equipment spread(s) may themselves function as a distributed control system for the distributed pumping system 100.

One or more components of the clean equipment spread 110 described herein may be mounted on a vehicle or trailer, or may be configured for ground deployment. A trailer may include one or more elements of the clean equipment spread 110, including one or more sensors, valves, pump units 204, components of fluid handling equipment 202, the manifold 206, components of chemical injection equipment 208, and any other elements included in the clean equipment spread 110. In other embodiments, the one or more sensors, valves, pump units 204, components of fluid handling equipment 202, manifold 206, components of chemical injection equipment 208, and any other elements in the clean equipment spread 110 may be distributed across many trailers. Vehicle-mounted configurations may be beneficial if components of the clean equipment spread 110 need to be quickly replaced as it enables other vehicles to quickly replace worn or damaged equipment. Vehicle-mounted configurations may also be beneficial if the clean equipment spread 110 needs to be quickly moved from one location in the well region to another, for example, such as when the clean equipment spread 110 is being traded out for a slurry equipment spread to pump well treatments to the well 106 at the location.

Each clean equipment spread 110 includes a smaller number of pump units 204 than the total number of pump units within the distributed pumping system (e.g., 100 of FIG. 1). As such, the clean equipment spread 110 takes up a smaller footprint at its location 200 than is necessary to contain all the pump units performing the well treatment pumping operations. Since the location 200 features a smaller well pad, this reduces the environmental impact on the location throughout the distributed pumping operations, as compared to systems where the entire pumping system is disposed at a single location.

Figure 3:
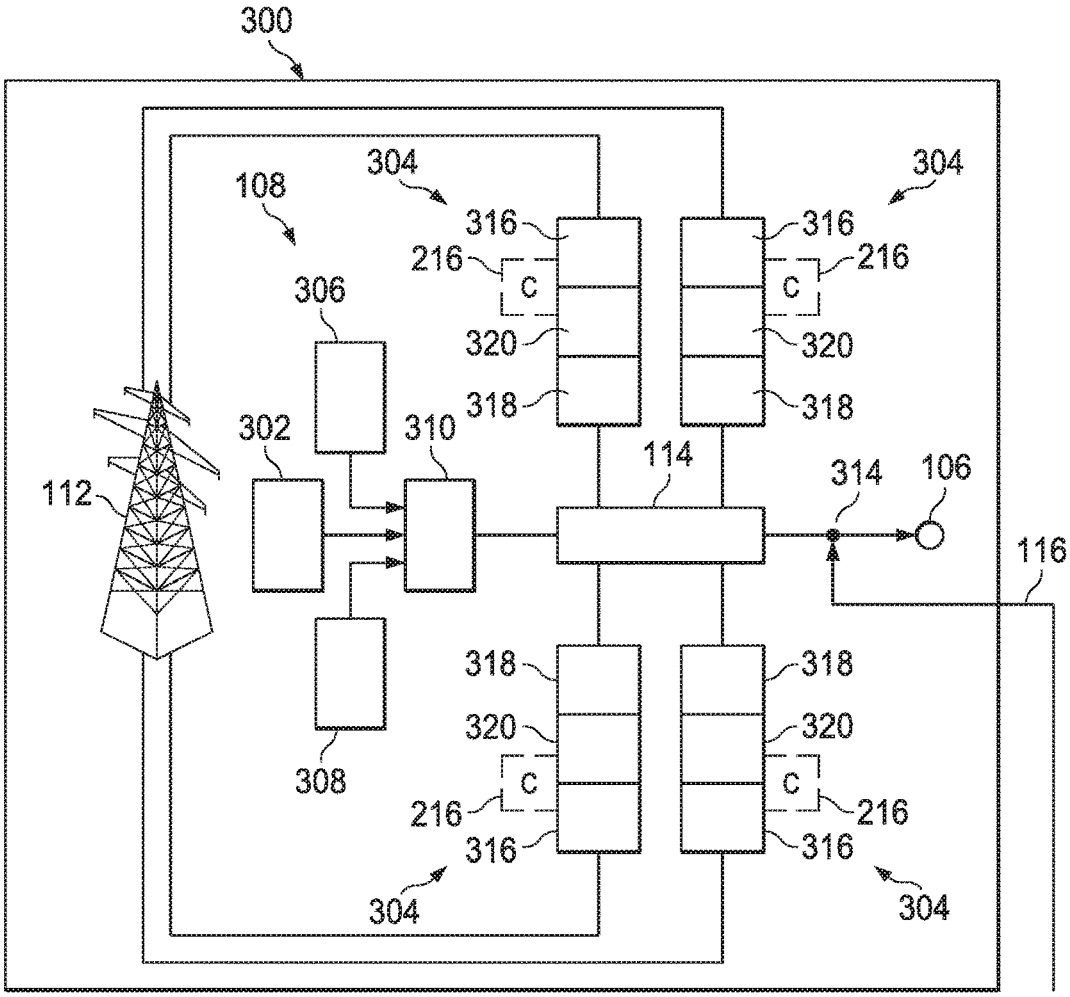
FIG. 3 is a schematic block diagram of a slurry equipment spread, in accordance with an embodiment of the present disclosure.

A more detailed description of the equipment that makes up a slurry equipment spread 108 will now be provided. FIG. 3 illustrates an embodiment of the equipment disposed at a slurry location 300. The term "slurry location" 300 refers to any location (e.g., 102A of FIG. 1; 102B of FIG. 4) at which a slurry equipment spread 108 is currently located. The term "well treatment location" refers to any location (e.g., 102A of FIG. 1; 102B of FIG. 4) in which a well bore is being treated. This may or may not be the same location where a slurry equipment spread 108 is located, as discussed below. As one or more components of the slurry equipment spread 108 may be moved throughout the course of treating wells at different locations throughout a region, the location itself may later become a clean location in which clean equipment provides pumping for a remote well treatment operation. Although the slurry equipment spread 108 may be moved from the location, any corresponding grid infrastructure 112 will remain in place at the location.

As shown in FIG. 3, the slurry location 300 may include, among other things, the slurry equipment spread 108 and the grid power supply 112. In some embodiments, the slurry location 300 may also include one or more subterranean wellbores 106. In other embodiments, the slurry location 300 may not include a subterranean wellbore 106 but instead may be used to remotely provide and pump slurry to a well treatment location separate from the slurry location 300. The slurry equipment spread 108 may include, among other things, fluid handling equipment 302, at least one slurry pump unit 304 (or pump unit 304) that runs on electrical power, solids handling equipment 306, gel handling equipment 308, and a blender 310. In embodiments where one or more wellbores 106 are located at the slurry location 300, the slurry equipment spread 108 may also include a high pressure manifold 114 coupling the pump(s) 304 to the one or more wellbores 106 at the location 300, and a fluid injection point 314 through which the piping network 116 injects pressurized clean fluid into the slurry generated by the blender 310. In some embodiments, the fluid handling equipment 302 may not be movable with the rest of the slurry equipment spread 108 but instead remains at the same location throughout different distributed pumping operations. The pump unit(s) 304 may be disposed at the slurry location 300 proximate a wellbore 106, as shown. In other embodiments, the pump unit(s) 304 may be disposed at a slurry location that is remote from one or more wellbores to which the slurry will be pumped.

The grid power supply 112 may include power lines or another connection to an infield power grid or a remote power grid, similar to the grid infrastructure described above with reference to FIG. 2. The grid power supply 112 at the location 300 may supply electrical power sufficient to operate components of the slurry equipment spread 108. For example, the amount of power transmitted via the grid power supply 112 may be greater than or equal to an amount sufficient to power one pump unit 304 and less than a total amount of power required to perform the entire well treatment. The amount of power provided via the grid power supply 112 at the slurry location 300 may be similar to or approximately equal to the amount of power transmitted via grid infrastructure 112 at the clean location 200. In some embodiments, the amount of power provided via grid power supply 112 at each location of the distributed power system may be approximately the same.

Turning now to components of the slurry equipment spread 108, the fluid handling equipment 302 may include one or more of a fluid storage system, a fluid communication system, and/or a fluid treatment system. A fluid storage system may include one or more fluid sources in the form of, for example, portable tanks, a ground water source, a pond, or some other fluid retention system. On-location fluid sources may not be movable along with portable equipment of the slurry equipment spread 108. A fluid communication system may include a conduit connecting a remote fluid source to the slurry location 300, a conduit connecting the fluid source at the location 300 to the manifold 114, or a combination thereof. A fluid treatment system may include one or more components configured to treat the fluid from a fluid source prior to the fluid entering the pump units 304. Such fluid treatments may include cleaning or removing certain material from the source fluid, and/or mixing one or more additives into the source fluid to produce a treatment fluid with a desired fluid characteristic. Other components may be included in the fluid handling equipment 302 as will be apparent to a person of ordinary skill in the art. The fluid handling equipment 302 outputs a fluid to the blender 310.

The slurry equipment spread 108 may include at least one electrically powered pump unit 304. In the illustrated embodiment, the slurry equipment spread 108 includes four electrically powered pumps units 304 manifolded together via the manifold 114. However, other numbers (e.g., one, two, three, five, six, seven, eight, etc.) and arrangements of pump units 304 may be used in other embodiments of the slurry equipment spread 108. As illustrated, all the pump units 304 of the slurry equipment spread 108 may be electrically powered. It should be noted that, in some embodiments, one or more of the slurry pump units 304 may receive at least part of their operating power from sources other than electrical power or electric grid power. For example, one or more of the pump units 304 may be diesel-, natural gas-, or dual fuel-powered. These pump units 304 operated by non-grid power may be on location and used as back-ups and/or to augment the output of the other slurry pumping equipment if the grid power is not sufficient to run all of the pumping equipment. In some embodiments, all of the pump units 304 may receive their operating power from non-grid power sources. In addition, one or more of the non-pump equipment components of the slurry equipment spread 108 may be diesel-, natural gas-, or dual fuel-powered. This equipment may include, for example, a blender, solids handling equipment, fluid handling equipment, and so forth.

The pump units 304 may each include an electrically powered prime mover 316 and a pump 318. The pump units 304 may each also include a drive train 320. An electrically powered prime mover 316 may include any device or assembly that converts electrical energy into mechanical energy to drive the pump 318. For example, the prime mover 316 may be an electric motor. During pumping operations, the pump 318 may require between approximately 100 hp and 10,000 hp, more particularly between approximately 500 hp and 5,000 hp, from the prime mover 316. In embodiments where one or more pump units 304 at the location are non-grid powered, the one or more non-grid powered pump units 304 may include a prime mover that is powered, for example, by a Diesel, natural gas, or dual-fuel engine to operate a pump.

In some embodiments, the pump 318 may include a reciprocating pump, as defined above with respect to FIG. 2. As mentioned above, the pump units 304 of the slurry equipment spread 108 may include the same type of pumps as used in the clean equipment spread. In other embodiments, the pump units 304 of the slurry equipment spread 108 may include different types of pumps as those used in the clean equipment spread. The drive train 320 may be coupled to the prime mover 316 and the pump 318 through one or more drive shafts (not shown), and may include a hydraulic or mechanical transmission that transmits energy from the prime mover 316 to the pump 318. For instance, to the extent the pump 318 is a reciprocating pump, the transmitted energy may include torque that drives the pump 318. In other embodiments, the pump 318 may use a hydraulic transmission such that hydraulic fluid cycles hydraulic cylinders to actuate each plunger in the pump 318.

The solids handling equipment 306 may include one or more components for managing the receiving, handling, movement, and output of solid materials that will be mixed into a fluid to form a well treatment fluid. These one or more components may include, for example, tanks, silos, portable containers, hoppers, conveyors, sand screws, chutes, valves, metering gates, dust management systems, platforms, and so forth configured to facilitate a controlled output of solids such as bulk material or solid additives used in the formation of the well treatment fluid. The solids handling equipment 306 may output solids to the blender 310. The polymer handling equipment 308 may include one or more components for generating and outputting a polymer (e.g., such as a gel or a friction reducer) to the blender 310.

The blender 310 may include one or more blenders for producing one or more slurry compositions. The slurry compositions produced by the blender 310 may include one or more components, including without limitation one or more base fluids, one or more gases, one or more liquids, one or more solids, one or more polymers, and any combination thereof that may be used in the well treatment fluid. In some embodiments, the slurry composition may include one or more of water from any source, proppant, cement, gelling agents, breakers, surfactants, crosslinkers, viscosity altering chemicals, PH buffers, modifiers, stabilizers, friction reducers, and diverting agents. As illustrated, the blender 310 may be communicatively coupled to outputs of the fluid handling equipment 302, the solids handling equipment 306, and/or the polymer handling equipment 308 for receiving one or more fluids, solids, and/or polymers and mixing these components to form the slurry composition. The blender 310 may in turn be in fluid communication with the one or more pump units 304 through a low pressure manifold. In some embodiments, the low pressure manifold may be included in a manifold trailer that also includes the high pressure manifold 114, as will be apparent to those of ordinary skill in the art.

In embodiments where the slurry equipment spread 108 is at the same location as one or more wellbores 106 to be treated, the slurry equipment spread 108 may include the high pressure manifold 114. The high pressure manifold 114 may provide fluid communication between the pump units 304 and one or more wellbores 106 at the slurry location 300. The high pressure manifold 114 may be a high pressure iron configured to communicate abrasive slurry at high pressures for treating a wellbore 106. In some embodiments, the slurry equipment spread 108 may also include a fluid injection point 314 positioned along the communication flow path between the pump unit(s) 304 and the wellbore 106. The injection point 314 may be incorporated into or integral with the high pressure manifold 114. In other embodiments, the injection point 314 may be located at the wellhead above the wellbore 106 such that the pressurized clean fluid from the piping network bypasses the high pressure manifold 114.

The fluid injection point 314 represents a point in which a flow path of the piping network 116 carrying the pressurized clean fluid intersects a flow path carrying pressurized slurry output via the slurry equipment spread 108. The pressurized clean fluid pumped from one or more clean locations (e.g., 102B, 102C, and 102D of FIG. 1; 200 of FIG. 2) is injected a flow path from the slurry equipment spread 108 to further increase the flow rate of and dilute the slurry to form the final treatment fluid being pumped to the wellbore 106 (which may be at the same or a different location than the slurry location 300).

In embodiments where the slurry equipment spread 108 is at a different location than one or more wellbores 106 to be treated, the slurry equipment spread 108 may include a high pressure manifold 114 that combines the flow of pressurized slurry from multiple pump units 304 and outputs the slurry through a flow path toward a remote location. In such embodiments, the fluid injection point 314 at which the slurry and clean fluids are combined may be located at the remote location where the one or more well bore(s) being treated are located.

A well treatment operation comprising a stimulation operation using the disclosed slurry equipment spread 108 will now be described. The blender 310 may receive fluid from the fluid handling equipment 302 and mix the fluid with a proppant, such as sand, or another granular material from the solids handling equipment 306 (and possibly a polymer from the polymer handling equipment 308) to produce a slurry that is directed to the pump unit(s) 304. The pump unit(s) 304 may pressurize the slurry to generate pressurized slurry that is output via the high pressure manifold 114 toward one or more wellbore(s). In some embodiments, a portion of the flow path downstream of the high pressure manifold 114 may simultaneously receive pressurized clean fluid communicated from the piping network 116 to the injection point 314. The pressurized clean fluid mixes with the pressurized slurry to form a final treatment fluid either before or at the wellbore 106, and the pressurized treatment fluid is pumped downhole to generate fractures within a formation in fluid communication with the wellbore 106.

The high pressure manifold 114, injection point 314, any other connections to the piping network 116, and any other fluid lines included in or coupled to the slurry equipment spread 108 may include valving and one or more sensors for control and monitoring of the flow of slurry (or final treatment fluid) during distributed pumping operations. A control system of the distributed pumping system may receive signals from sensors and/or output control signals to the valving to control the final treatment fluid output from the system. As illustrated, each of the pump units 304 may be equipped with pump controllers 216 as described above with reference to FIGS. 1 and 2.

One or more components of the slurry equipment spread 108 described herein may be mounted on a vehicle or trailer, or may be configured for ground deployment. A trailer may include one or more elements of the slurry equipment spread 108, including one or more sensors, valves, pump units 304, components of fluid handling equipment 302, solids handling equipment 306, polymer handling equipment 308, the blender 310, the high pressure manifold 114, the injection point 314, and any other elements that may be included in the slurry equipment spread 108. In other embodiments, the one or more sensors, valves, pump units 304, components of fluid handling equipment 302, solids handling equipment 306, polymer handling equipment 308, the blender 310, the high pressure manifold 114, the injection point 314, and any other elements that may be included in the slurry equipment spread 108 may be distributed across many trailers. Vehicle-mounted configurations may be beneficial if components of the slurry equipment spread 108 need to be quickly replaced as it enables other vehicles to quickly replace worn or damaged equipment. Vehicle-mounted configurations may also be beneficial if the slurry equipment spread 108 needs to be quickly moved from one location in the well region to another, for example, such as when the slurry equipment spread 108 is being traded out for a clean equipment spread to pump well treatments at a different location.

Each slurry equipment spread 108 includes a smaller number of pump units 304 than the total number of pump units within the distributed pumping system (e.g., 100 of FIG. 1). As such, the slurry equipment spread 108 takes up a smaller footprint at its location 300 than is necessary to contain all the pump units performing the well treatment pumping operations. Since the location 300 features a smaller well pad, this reduces the environmental impact on the location throughout the distributed pumping operations, as compared to systems where the entire pumping system is disposed at a single location.

Turning back to FIG. 1, the distributed pumping system 100 may operate to provide a well treatment to the wellbore 106 at location 102A by operating one or more pumps at one or more of the clean equipment spreads 110 in the region 104 to output pressurized clean fluid through the piping network 116 toward the location 102A. The clean fluid is then combined with a slurry generated at the location 102A via the slurry equipment spread 108 to form the pressurized final treatment fluid used to treat the wellbore 106 at the location 102A. This process may be repeated until all wells at the location 102A are treated.

Figure 4:
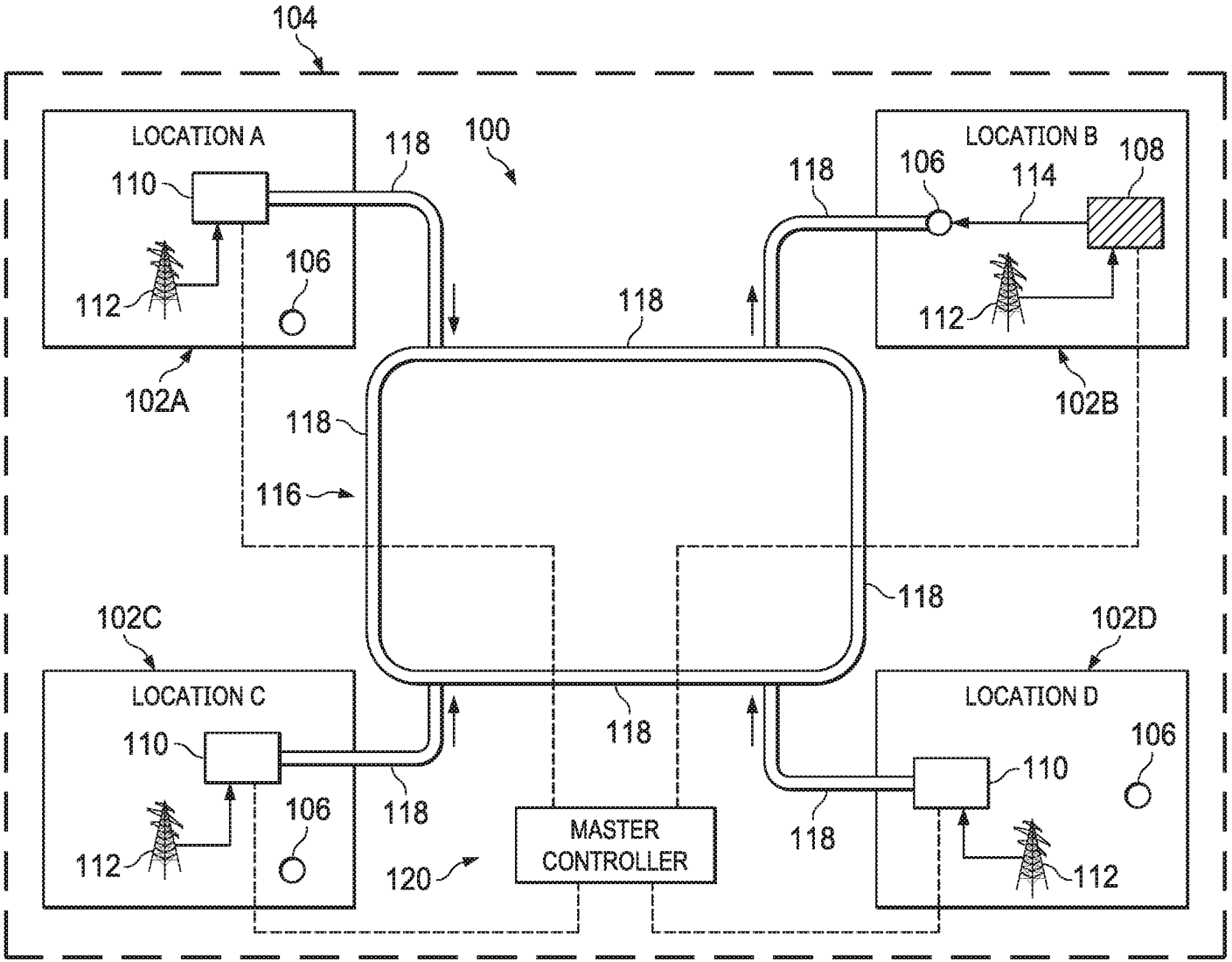
FIG. 4 is a schematic block diagram of the distributed pumping system of FIG. 1 having the slurry equipment spread exchanged with one of the clean equipment spreads, in accordance with an embodiment of the present disclosure.

After stimulating the wellbore(s) 106 at this location 102A, it may be desirable to stimulate a wellbore 106 at a different location (e.g., 102B) in the region 104. To accomplish this, the slurry equipment spread 108 at location 102A may be exchanged with the clean equipment spread 110 at location 102B. This interchanging of the slurry equipment spread 108 and clean equipment spread 110 is illustrated in FIG. 4. During this swap, the clean equipment spreads on locations 102C and 102D may remain in their original locations. Pumping may resume from the slurry equipment spread 108 and one or more of the clean equipment spreads 110 until all wells 106 located at location 102B are treated.

This process of swapping equipment spreads of two different locations and operating the distributed pumping system 100 to perform well treatments on wells may be repeated for each remaining location (e.g., 102C and 102D) having wellbores 106 until all wells in the region 104 are completed. By swapping the slurry equipment spread 108 with clean equipment spreads 110, the distributed pumping method may minimize the exposure of the equipment to abrasive slurries. That is because only the equipment (e.g., high pressure manifold 114/flow path and pump units) of the slurry equipment spread 108 are exposed to the abrasive slurries. In addition, exchanging the slurry equipment spread 108 for one clean equipment spread 110 at a time whenever a new wellsite is to be completed requires moving fewer pieces than if all components of the pumping system were disposed at the same location. This leads to mobilization cost savings and increases efficiency of completing wells in a field since there is less equipment to move and rig up each time the slurry equipment transitions to a new location. The clean equipment spreads 110 may stay at each site longer than they would in a non-distributed well treatment system. This makes installation of additional infrastructure (e.g., for maintenance, automation, or remote operation) more economically feasible.

As illustrated, the piping network 116 of FIGS. 1 and 4 is such that all locations 102 in the region 104 are fluidly connected in series. That is, the piping network 116 includes flow paths 118 that directly couple the first location 102A to the second location 102B, the second location 102B to the third location 102C, the third location 102C to the fourth location 102D, and the fourth location 102D to the first location 102A. This allows the clean fluid to be pumped in either direction from each of the clean locations toward the slurry location. In addition, this series configuration means that switching the slurry location only requires exchanging at least a portion of the slurry equipment spread 108 for one of the clean equipment spreads 110, without changing the flow paths 118 of the piping network 116. Other configurations of the piping network 116 may be used in other embodiments, as described below.

Figure 5:
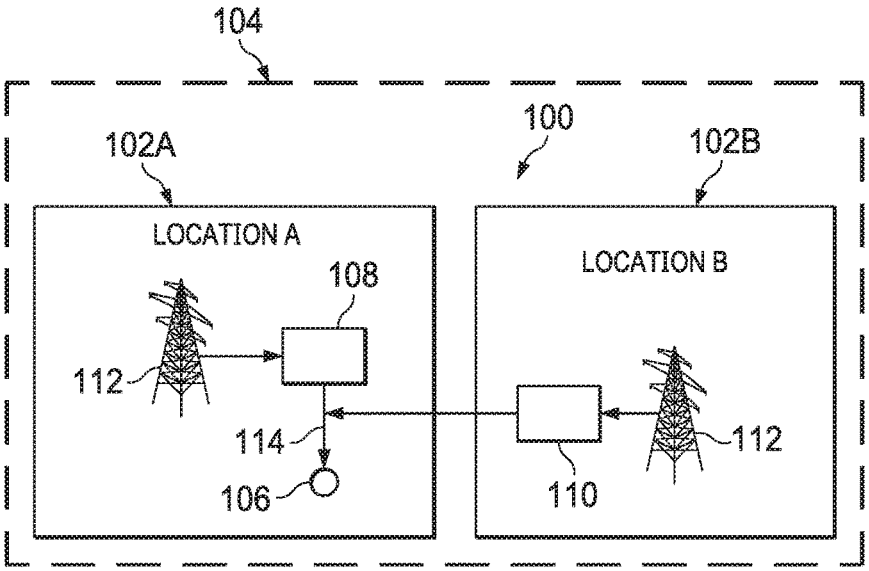
FIG. 5 is a schematic block diagram of a distributed pumping system having a slurry equipment spread and a clean equipment spread at different locations in a well field, in accordance with an embodiment of the present disclosure.

It should be noted that any number of locations or well sites may be present in a region 104 in which the distributed pumping system 100 is used. For example, as shown in FIG. 5, the region 104 may have as few as two locations 102 in which the pumping system 100 is distributed. As illustrated in FIG. 5, the distributed pumping system 100 may include a single slurry equipment spread 108 and a single clean equipment spread 110 that are connected across their different locations 102A and 102B, respectively, via a piping network 116 including a single flow path.

In other embodiments, there may be different numbers of clean equipment spreads 110 operating with one or more slurry equipment spreads 108 to perform well treatments. For example, the distributed pumping system 100 may include two, three, four, five, six, seven, eight, nine, ten, eleven, twelve, or any other desired number of clean equipment spreads 110 disposed at different locations 102 within the region 104 and connected via a piping network 116. In addition, different numbers of slurry equipment spreads 108 may be operated with or without clean equipment spread(s) 110 to perform well treatments. For example, the distributed pumping system 100 may include two, three, four, five, six, seven, eight, or any other desired number of slurry equipment spreads 108 disposed at different locations 102 within the region 104 and connected via a piping network 116.

The exact number of locations 102 about which the distributed pumping system 100 is disposed may be selected or adjusted to match the total power requirements for the treatment (e.g., stimulation) operations with the power available via the grid infrastructure 112 (and/or other available power sources) at each location 102. The number of pump units (e.g., 204 and 304) that are included in each clean equipment spread 110 and/or slurry equipment spread 108 may be selected based on the hydraulic horsepower required by the well 106 being treated, the percent capacity at which it is desired to run the pumps, and the amount of proppant desired to be pumped.

Figure 10:
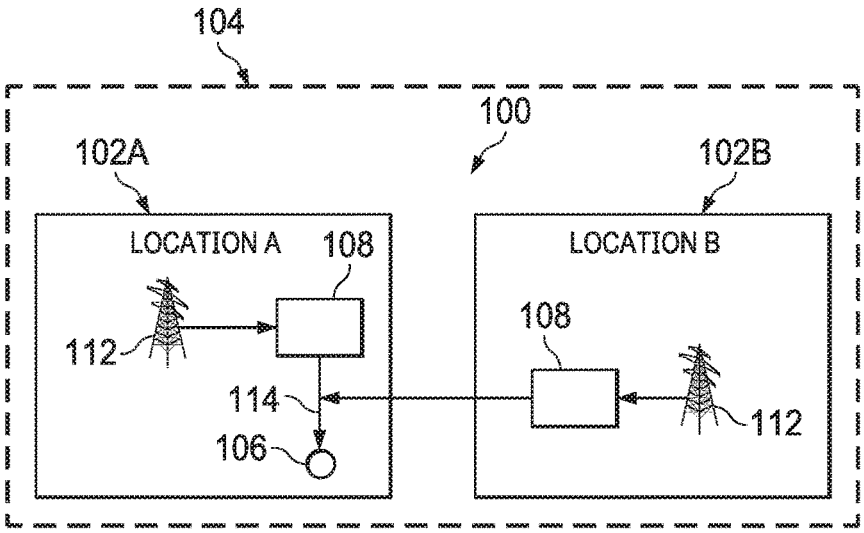
FIG. 10 is a schematic block diagram of a distributed pumping system having multiple slurry equipment spreads at different locations in a well field, in accordance with an embodiment of the present disclosure.

In certain embodiments, the distributed pumping system 100 may include multiple slurry equipment spreads 108 or even entirely slurry equipment spreads 108 without any clean equipment spreads 110. For example, FIG. 10 illustrates an embodiment in which all locations 102 are equipped with slurry equipment spreads 108 having the associated equipment that is able to handle slurry.

Figure 6:
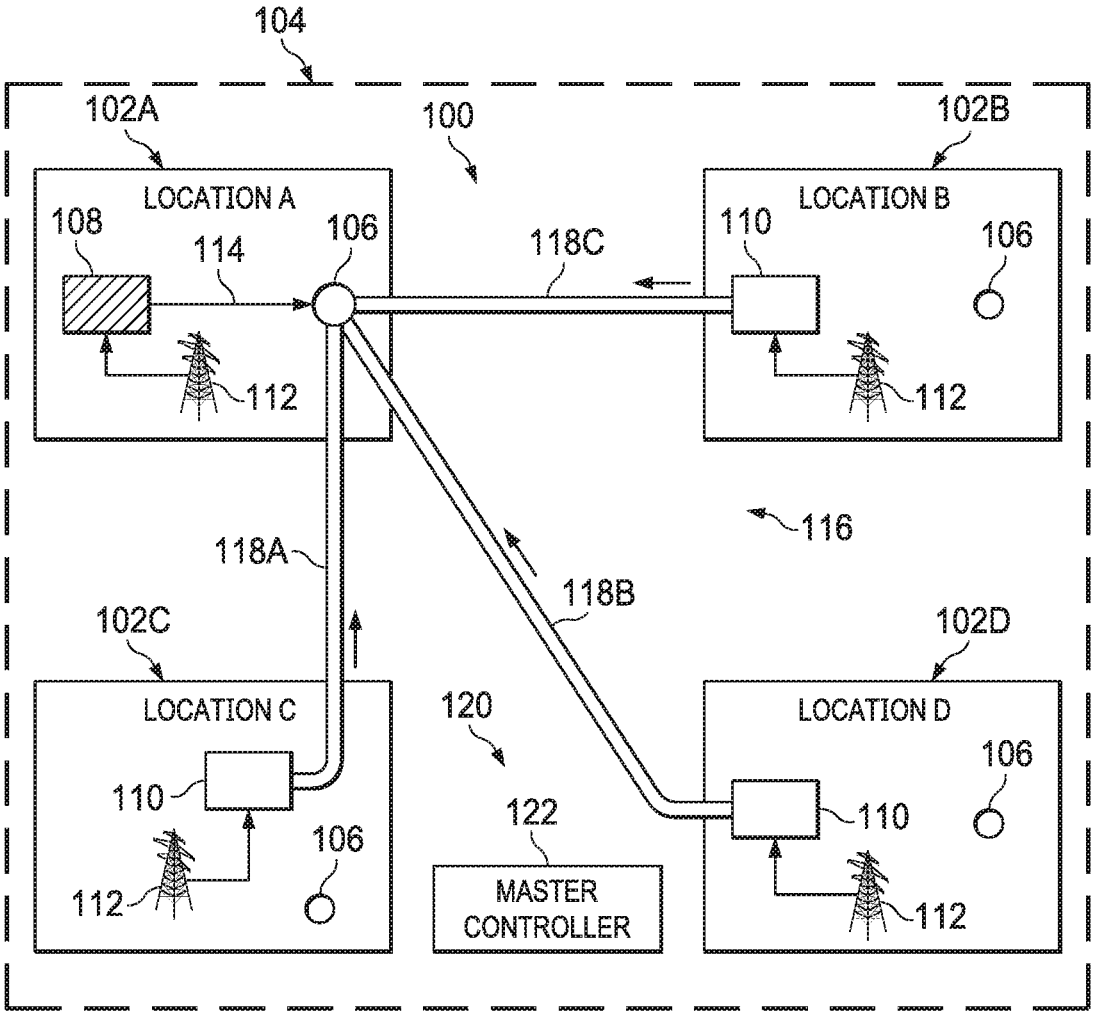
FIG. 6 is a schematic block diagram of a distributed pumping system having slurry and clean equipment spreads distributed in parallel, in accordance with an embodiment of the present disclosure.

As discussed above, the disclosed distributed pumping system 100 may have a configuration for fluidly connecting the various locations 102 that is different from the series connection of FIGS. 1 and 4. For example, FIG. 6 illustrates a configuration of the distributed pumping system 100 having parallel connections between the clean locations 102B, 102C, 102D and a well treatment location 102A. In the embodiment of FIG. 6, the slurry equipment is located at the well treatment location 102A. In this configuration, the piping network 116 may include multiple individual flow paths 118 extending one from each of the locations 102B, 102C, and 102D directly to the location 102A. The high pressure manifold 114 or the wellhead at location 102A may be configured to receive each individual flow of pressurized clean fluid from the locations 102B, 102C, and 102D to combine with the slurry and treat the well 106 at location 102A. In this configuration, any valving in the piping network 116 may be controlled to allow one-way communication of fluid from each of the clean locations 102B, 102C, and 102D to the well treatment location 102A.

When it is desired to move at least a portion of the slurry equipment spread 108 from one location 102A to another (e.g., 102B), a portion of the piping network 116 may need to be moved as well to maintain a parallel connection between the clean locations 102A, 102C, and 102D and the new well treatment location 102B. For example, the shorter length of pipe 118A between locations 102A and 102C may be moved so that it then extends between locations 102B and 102D, and the longer length of pipe 118B between locations 102A and 102D may be moved so that it then extends between locations 102B and 102C. In other embodiments, the elongated lengths of pipe 118 may be kept in their original locations, but plumbing may be added at location 102A to connect the flowlines such that the flow paths 118A and 118B feed into flow path 118C. At the same time, the plumbing at or near the high pressure manifold 114 may be adjusted so that a single injection point is provided for the flow path 118C to feed clean fluid into the slurry equipment flow path.

Figure 7:
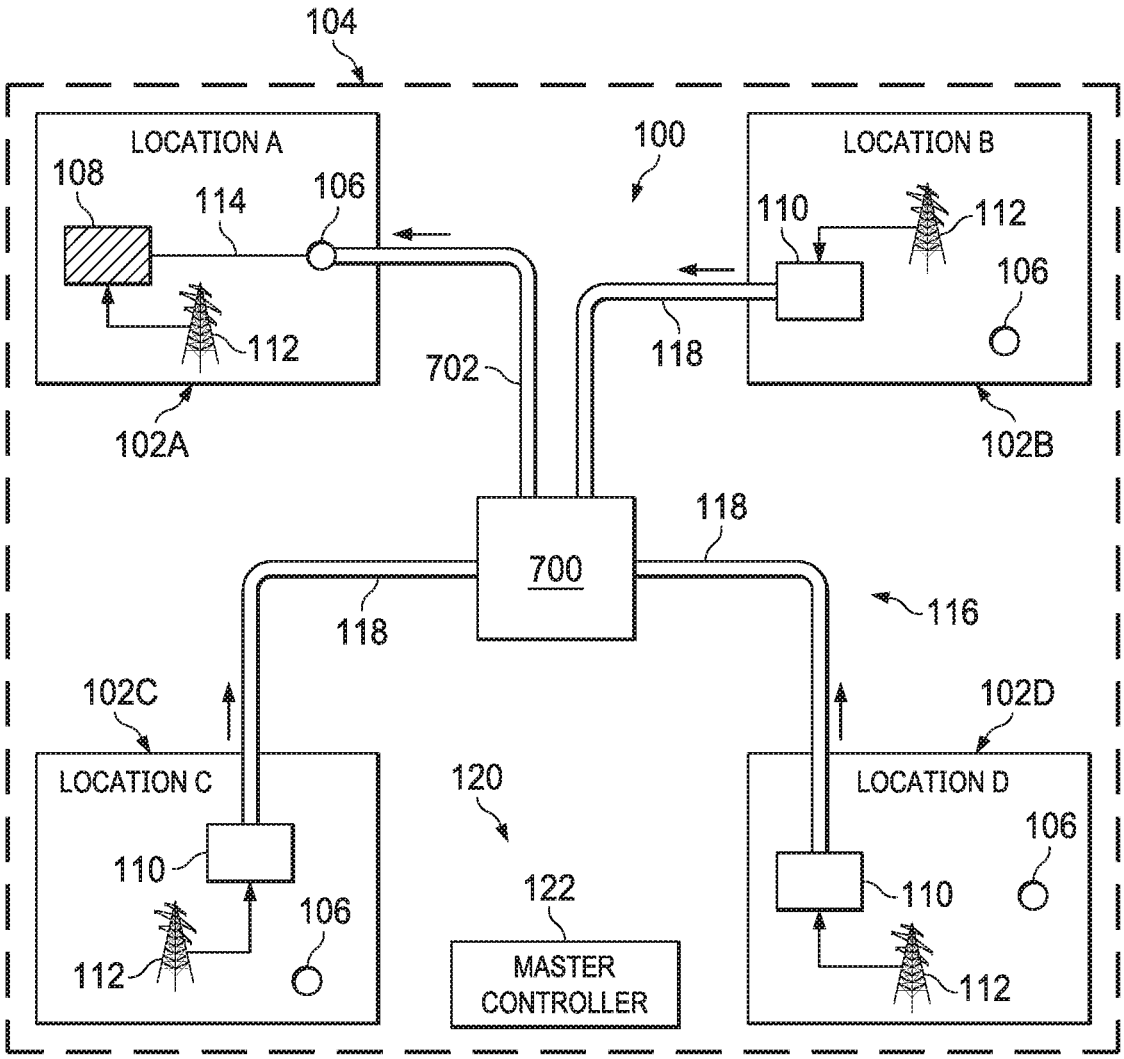
FIG. 7 is a schematic block diagram of a distributed pumping system having slurry and clean equipment spreads distributed about a central manifold, in accordance with an embodiment of the present disclosure.

In other embodiments, as shown in FIG. 7, the distributed pumping system 100 may have a hybrid configuration in which all the clean equipment spreads 110 at locations 102B, 102C, 102D pump clean fluid to a central hub 700, and one additional clean line 702 is installed coupling the central hub 700 to the treated well bore location 102A. This allows for parallel pumping while requiring less plumbing to move as compared to the parallel pumping arrangement of FIG. 6. The central hub 700 may include a fluid manifold that combines the flows from each flow path 118 into a single flow through the clean line 702. An end of the clean line 702 may be moved each time the slurry equipment spread 108 is moved, but no other lines 118 need to be rearranged and no additional plumbing is added or removed from the high pressure manifold 114 of the slurry equipment spread 108.

Figure 8:
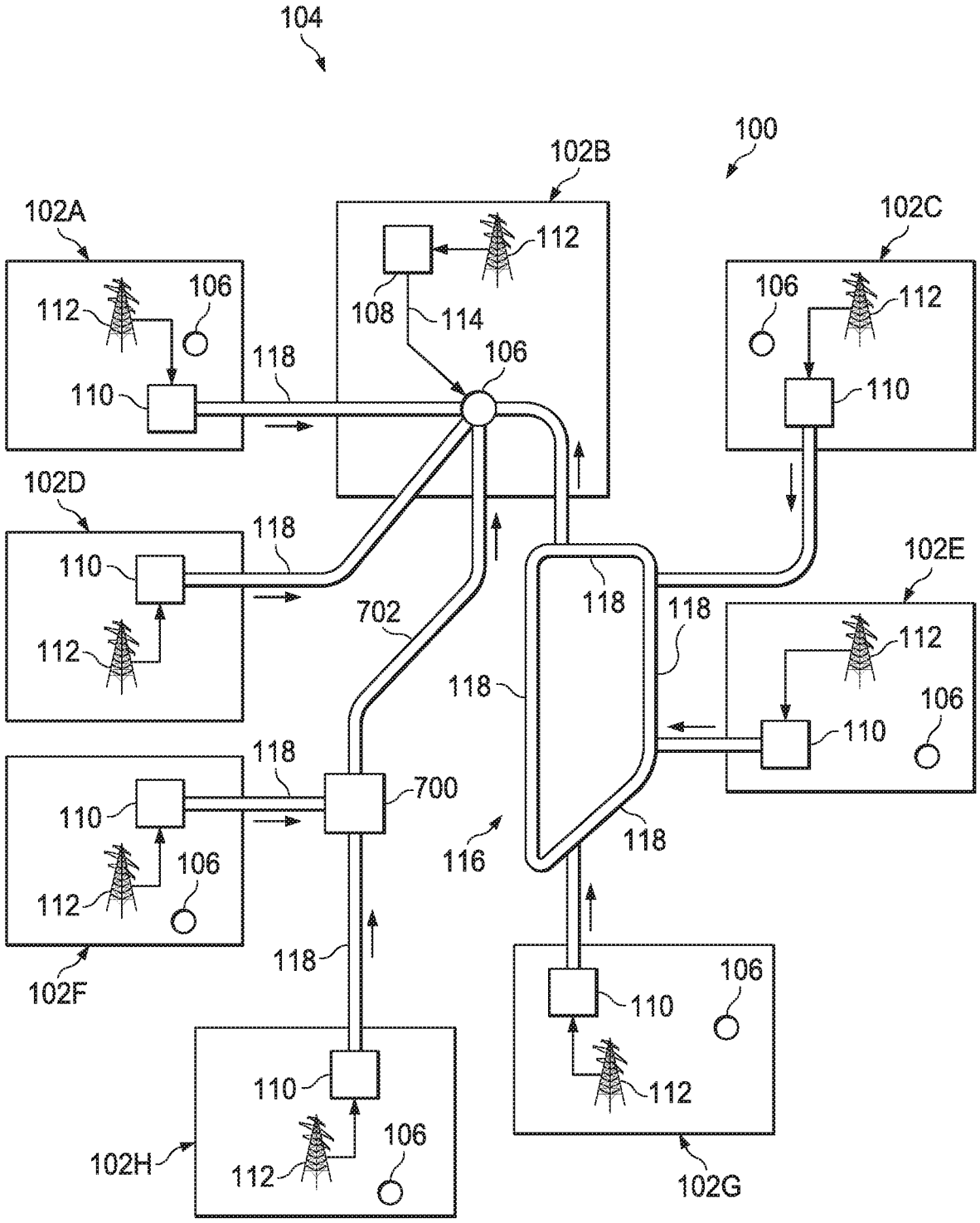
FIG. 8 is a schematic block diagram of a distributed pumping system having slurry and clean equipment spreads distributed in a hybrid configuration, in accordance with an embodiment of the present disclosure.

In still other embodiments, any combination of the different configuration of the piping network 116 may be used. FIG. 8 illustrates an embodiment of the distributed pumping system 100 having a combination of different piping network configurations therein. Selecting which configuration (series, parallel, hybrid, etc.) of piping network 116 to use for connecting several locations 102 in a region 104 may depend on the relative spacing between the locations 102. It may be desirable to select a configuration of the piping network 116 that minimizes the total length of pipeline needed or the number of moves of pipelines needed to swap the treatment locations.

As shown in FIG. 8, not all locations 102 in which the clean equipment spreads 110 are disposed need to include a wellbore 106. For example, the location 102D in FIG. 8 does not include a well, since the location 102D is not at a well site. Instead, the location 102D is at an infield site where grid power is available. In other embodiments, one or more clean equipment spreads 110 may be located at a near field site (e.g., just outside the region 104) where grid power in available.

Figure 11:
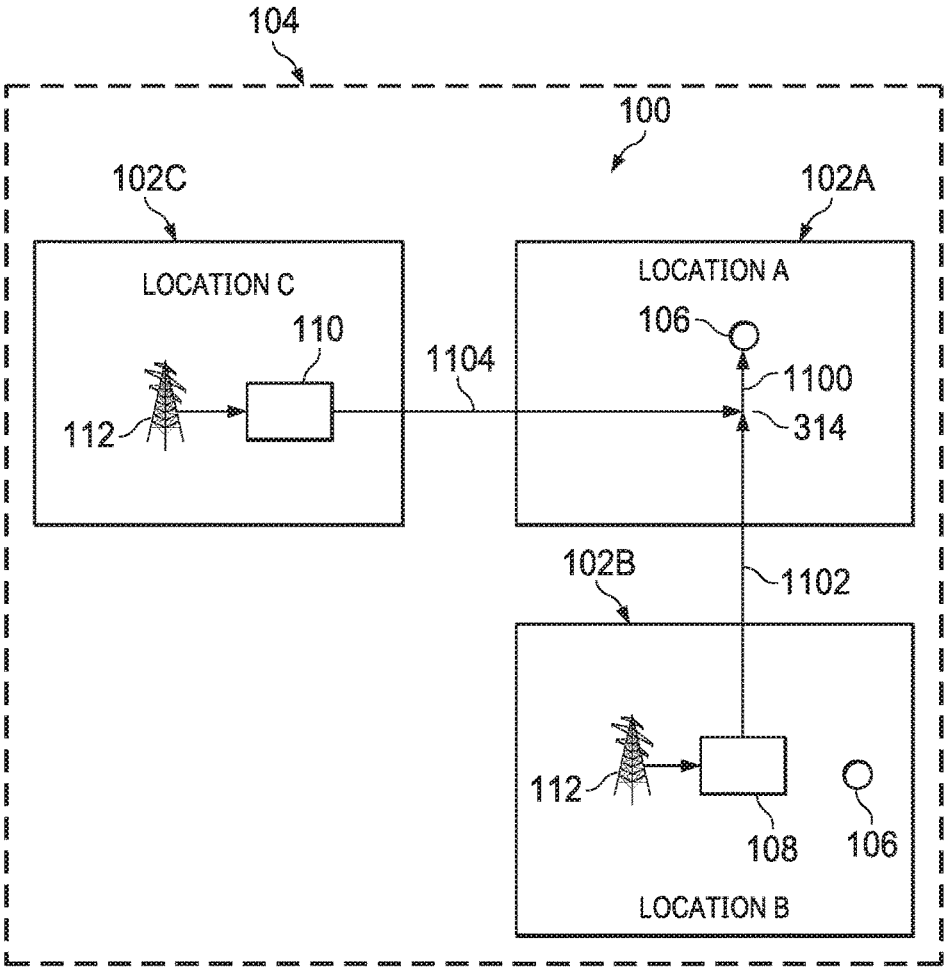
FIG. 11 is a schematic block diagram of a distributed pumping system having a clean equipment spread and a slurry equipment spread at different locations each outputting pressurized fluid to a well at a third location, in accordance with an embodiment of the present disclosure.

FIG. 11 illustrates an embodiment of the distributed pumping system 100 in which multiple flows of fluid are pumped to and combined at a well treatment location 102A in which no equipment spreads are located. For example, FIG. 11 shows the well treatment location 102A having a well bore 106 and a fluid injection point 314 at which pressurized clean fluid is combined with pressurized slurry to form the well treatment fluid. A manifold 1100 may also be located at the well treatment location 102A and coupled to the well bore 106 to combine the different pressurized fluid flows. As illustrated, a flow path 1102 may couple a separate slurry location 102B in which the slurry equipment spread 108 is located to the well treatment location 102A, while a flow path 1104 may couple a separate clean location 102C in which the clean equipment spread 110 is located to the well treatment location 102A. The flow path 1102 leading from the slurry location 102B to the well treatment location 102A may be configured specifically to handle the corrosive pressurized slurry flowing therethrough. If it is desired to switch from treating the well bore 106 at the remote well treatment location 102A to treating a well bore 106 at the slurry location 102B, the high pressure manifold 114 may simply be reconfigured to direct pressurized slurry directly to the well bore 106 at the location 102B instead of to the flow path 1102, and the flow path 1104 may be moved to fluidly couple the clean location 102C to the slurry location 102B for injection at the location 102B.

The control system described above may control operation of the pumps of the slurry equipment spread 108 and clean equipment spreads 110 in various ways to meet the well treatment requirements while improving maintenance and other operations at the various locations 102. For example, in some embodiments, the control system may control the pumps such that any available pumps that are not currently being used for pumping are distributed among all sites. This may lower the amount of grid power required at each location 102 to support the well treatment operations. In other embodiments, the control system may control the pumps such that all the pumps at one location 102 are not operating. This facilitates easier maintenance because there are no red zones at the non-operational location 102, so maintenance can be performed on all pumps at that location quickly and easily. In addition, if a problem or potential hazard is detected in one or more pumps at one of the locations 102, all pumps may be shut off at the affected location and replaced by other pumps coming online at other locations to continue well treatment operations. As such, the disclosed distributed pumping system 100 increases flexibility in managing equipment assets at the various locations 102 throughout pumping operations.

Figure 9:
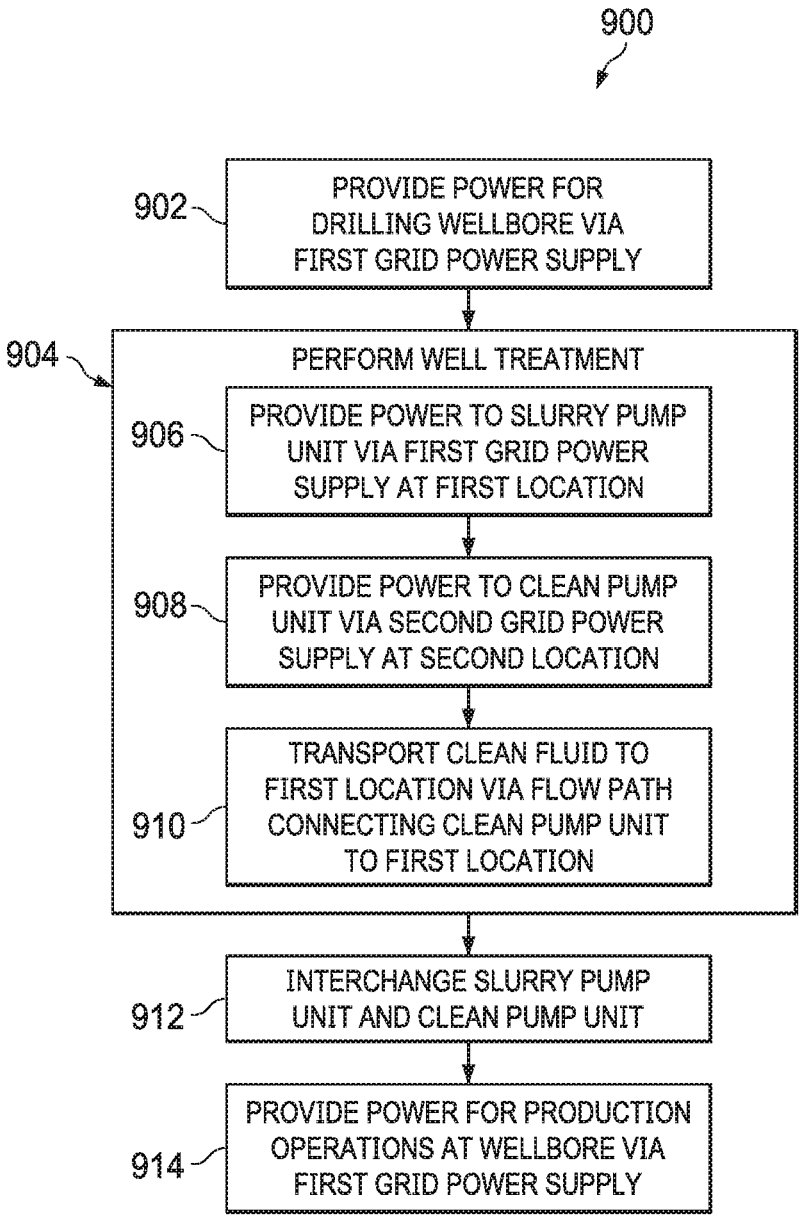
FIG. 9 is a process flow diagram of a method for operating a distributed in-field powered pumping system in accordance with an embodiment of the present disclosure.

FIG. 9 is a process flow diagram of a method 900 for providing grid powered operations at a well region in accordance with an embodiment of the present disclosure. The method 900 may include providing (block 902) power for drilling a well bore 106 via a first grid power supply 112 prior to performing completion operations at the well. The method 900 then includes performing (block 904) a well treatment on the well using power from the first grid power supply 112 and a second grid power supply 112 at another location. The well treatment 904 includes providing (block 906) power to a slurry pump unit 304 via the first grid power supply 112, wherein the slurry pump unit 304 and the grid power supply 112 are disposed at a first location proximate a first well bore 106. The well treatment 904 also includes providing (block 908) power to a clean pump unit 204 via a second grid power supply 112, wherein the pump unit 204 and the second grid power supply 112 are disposed at a second location. The well treatment 904 also includes transporting (block 910) clean fluid pressurized by the pump unit 204 to the first location via a flow path 118 fluidly connecting the pump unit 204 to the first location. In some embodiments, the slurry pump unit 304 may be operated entirely via the power provided from the first grid power supply 112, and the pump unit 204 may be operated entirely via the power provided from the second grid power supply 112. In some embodiments, the method 900 may further includes allowing (block 912) the slurry pump unit 304 and the pump unit 204 to be interchanged with each other between the first and second locations, thus enabling treatment of one or more wells at the second location. The method 900 may further includes providing (block 914) power for production operations at the first well bore 106 via the first grid power supply 112 after treating the well.

As such, the disclosed embodiments may include a distributed in-field powered pumping system that includes at least two pump units, at least one of these pump units being a slurry pump unit, disposed at different locations. For example, the first pump unit (which may be a clean pump unit or a slurry pump unit) is disposed at a first location, while the second pump unit (which may be a slurry pump unit) is disposed at a second location. The first pump unit and the second pump unit may each receive power at a prime mover to operate their associated pump, as described above. The first pump unit receives operational power from a first power supply, while the second pump unit receives operational power from a second power supply.

The first power supply may be an electrical, mechanical, or hydraulic power supply, and the second power supply may similarly be an electrical, mechanical, or hydraulic power supply. For example, the first power supply may include a grid power supply providing electrical power to a motor which acts as the prime mover on the first pump unit. In some embodiments, the first power supply may be another type of electrical power supply (e.g., a generator or battery) that provides electrical power to an electrical motor on the first pump unit. In some embodiments, the first power supply may include an engine (e.g., Diesel engine, natural gas engine, or dual-fuel engine) that burns fuel to directly generate mechanical energy at the prime mover of the first pump unit. In some embodiments, the second power supply may include a grid power supply providing electrical power to a motor which acts as the prime mover on the second pump unit. In some embodiments, the second power supply may be another type of electrical power supply (e.g., a generator or battery) that provides electrical power to an electrical motor on the second pump unit. In some embodiments, the second power supply may include an engine (e.g., Diesel engine, natural gas engine, or dual-fuel engine) that burns fuel to directly generate mechanical energy at the prime mover of the second pump unit.

In the disclosed embodiments, at least one of the first power supply and the second power supply is a grid power supply. As described above, the term "grid power supply" refers to any type of infrastructure that transmits or distributes electrical power about the region in which the first location and/or second location are located. This may include grid infrastructure that is built out from a remote utility grid to transmit power from the utility grid to the region, as well as grid infrastructure that distributes power generated at the in-field region. In some embodiments, the pump unit at the first location may be powered by a first grid power supply disposed at the first location, and the slurry pump unit at the second location may be powered by a second grid power supply at the second location. In other embodiments, only one of the pump unit at the first location and the slurry pump unit at the second location may be powered by a grid power supply disposed at its respective location, while the other may be mechanically, electrically, or hydraulically powered by another type of power supply disposed at its respective location. The above described layout of a pump unit and a slurry pump unit disposed at first and second locations, respectively in the region and powered by respective first and second power supplies can be extended to any desired number of pumps including at least one slurry pump in the region. For example, the system may also include a second pump unit disposed at a third location and powered by a third power supply (which is similar to the first/second power supplies) disposed at the third location. Each element depicted in the system may comprise one or more of each element.

For example, each pump described herein may comprise one or more pumps, each blender may comprise one or more blenders, and the storage systems may comprise one or more tanks and containers for storing material as well as systems for distributing and receiving additional storage material. Further, as described herein, a blender or blending system may further comprise one or more boost pumps. Additionally, the power source of the split flow pumping system may comprise one or more power sources, wherein the power sources may comprise electric sources, gas sources, diesel sources, natural gas sources, and any combination thereof.

As described herein, computers may comprise any suitable machine or network of machines capable of communicating with other network equipped devices including without limitation on-site equipment, notification devices, control devices, network devices, storage devices, and resources. Computers may comprise a processor or central processing unit configured for executing instructions, program instructions, process data, or any combination thereof. The processor may be configured to interpret and execute program instructions, software, or other data retrieved and stored in memory, including without limitation read-only memory (ROM), random access memory (RAM), solid state memory, or disk-based memory.

Modifications, additions, or omissions may be made to computers without departing from the scope of the present disclosure. Any suitable configurations of components may be used. For example, components of computers may be implemented either as physical or logical components. Furthermore, in one or more embodiments, functionality associated with computers may be implemented in special purpose circuits or components. In one or more embodiments, functionality associated with components of computers may be implemented in configurable general-purpose circuit or components, such as configured computer program instructions.

In any embodiment, computers may include a non-transitory computer readable medium that stores one or more instructions where the one or more instructions when executed cause the processor to perform certain actions. As used herein, a computer may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes.

While the present disclosure has been described in connection with one or more embodiments, it will be understood by those skilled in the art that it is not intended to limit the disclosure to those embodiments. It is therefore contemplated that various alternative embodiments and modifications may be made to the disclosed embodiments without departing from the spirit and scope of the disclosure defined by the appended claims and equivalents thereof. In particular, with regards to the methods disclosed, one or more steps may not be required in all embodiments of the methods and the steps disclosed in the methods may be performed in a different order than was described. The indefinite articles "a" or "an," as used in the claims, are defined herein to mean one or more than one of the element that that a particular article introduces; and subsequent use of the definite article "the" is not intended to negate that meaning. Further, embodiments described herein involving two elements contemplate applications involving two or more of the same element.

An embodiment of the present disclosure is a system including: a pump unit disposed at a first location, a slurry pump unit disposed at a second location, and at least one grid power supply. At least one of the pump unit and the slurry pump unit is powered by the at least one grid power supply. The system also includes a first flow path fluidly connected to the pump unit at the first location and configured to fluidly connect the pump unit to a well bore to be treated; and a second flow path fluidly connected to the slurry pump unit at the second location and configured to fluidly connect the slurry pump unit to the well bore to be treated.

In one or more embodiments described in the preceding paragraph, a first grid power supply is disposed at the first location, wherein the first grid power supply provides electrical power to the pump unit. In one or more embodiments described in the preceding paragraph, a second grid power supply is disposed at the second location, wherein the second grid power supply provides electrical power to the slurry unit. In one or more embodiments described in the preceding paragraph, the at least one grid power supply provides power transmitted from an infield power generation system located in a region in which the first location and the second location are located. In one or more embodiments described in the preceding paragraph, the at least one grid power supply provides power transmitted from a remote power generation system located away from a region in which the first location and the second location are located. In one or more embodiments described in the preceding paragraph, the first flow path includes at least one pipeline, and wherein the flow path is configured to provide bidirectional fluid flow. In one or more embodiments described in the preceding paragraph, the system further includes a blender disposed at the second location, wherein the blender is fluidly coupled to the slurry pump unit. In one or more embodiments described in the preceding paragraph, the slurry pump unit is disposed proximate a well bore at the second location; the first flow path connects the first location to the second location; and the second flow path includes a high pressure manifold disposed at the second location. In one or more embodiments described in the preceding paragraph, the first flow path connects the pump unit to an injection point either at the well bore or between the high pressure manifold and the well bore. In one or more embodiments described in the preceding paragraph, the pump unit is disposed at the first location proximate a second well bore. In one or more embodiments described in the preceding paragraph, the system further includes a second pump unit disposed at a third location; and a third flow path configured to fluidly connect the second pump unit to the well bore. In one or more embodiments described in the preceding paragraph, the third power supply is a third grid power supply is disposed at the third location, wherein the third grid power supply provides electrical power to the second pump unit. In one or more embodiments described in the preceding paragraph, wherein the pump unit at the first location is a slurry pump unit.

Another embodiment of the present disclosure is a system including: a first clean pump unit disposed at a first location and coupled to a first clean fluid source; a first grid power supply disposed at the first location, wherein the first grid power supply provides power to the first clean pump unit; a first flow path fluidly connected to the first clean pump unit to output pressurized clean fluid from the first clean pump unit toward a well bore; a slurry pump unit disposed at a second location; and a second flow path fluidly connected to the slurry pump unit to output pressurized slurry from the slurry pump unit toward the well bore.

In one or more embodiments described in the preceding paragraph, the system further includes: a second clean pump unit disposed at a third location and coupled to a second clean fluid source; a second grid power supply disposed at the third location, wherein the second grid power supply provides power to the second clean pump unit; and a third flow path fluidly connected to the second clean pump unit to output pressurized clean fluid from the second clean pump unit toward the well bore. In one or more embodiments described in the preceding paragraph, the first flow path directly connects the first location to the second location, and wherein the third flow path directly connects the third location to the first location. In one or more embodiments described in the preceding paragraph, the first flow path directly connects the first location to the second location, and wherein the third flow path directly connects the third location to the second location. In one or more embodiments described in the preceding paragraph, the system further includes a centralized hub coupled to the second location, wherein the first flow path directly connects the first location to the centralized hub, and wherein the third flow path directly connects the third location to the centralized hub.

Another embodiment of the present disclosure is a method including: providing a pump unit disposed at a first location; providing a slurry pump unit disposed at a second location; powering at least one of the pump unit and the slurry pump unit via at least one grid power supply; transporting fluid pressurized by the pump unit toward a well bore via a first flow path; and transporting slurry pressurized by the slurry pump unit toward the well bore via a second flow path.

In one or more embodiments described in the preceding paragraph, the pump unit is powered by a first grid power supply disposed at the first location and the slurry unit is powered by a second grid power supply disposed at the second location, and the method further includes: operating the pump unit entirely via the power provided from the first grid power supply; and operating the slurry pump unit entirely via the power provided from the second grid power supply.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A system, comprising:

a first clean pump unit disposed at a first location;

a first grid power supply that provides power to the first clean pump unit;

a slurry pump unit disposed at a second location, wherein the slurry pump unit is fluidly coupled to a high pressure manifold at the second location, wherein the high pressure manifold is fluidly coupled to a well bore at the second location, wherein the first location and the second location are 100 yards to 2 miles apart;

a second grid power supply that provides power to the slurry pump unit;

a first flow path fluidly connected to the first clean pump unit at the first location and configured to fluidly connect the first clean pump unit to the high pressure manifold at the second location or to a wellhead above the wellbore at the second location;

a second clean pump unit disposed at a third location, wherein the third location is 100 yards to 2 miles apart from the first location and from the second location;

a third grid power supply that provides power to the second clean pump unit;

a third clean pump unit disposed at a fourth location, wherein the fourth location is 100 yards to 2 miles apart from the first location, from the second location, and from the third location;

a fourth grid power supply that provides power to the third clean pump unit;

a piping network configured to provide bidirectional flow, wherein the first flow path is connected to the piping network;

a second flow path fluidly connected to the piping network and configured to fluidly connect the piping network to the high pressure manifold or to the wellhead above the wellbore at the second location;

a third flow path fluidly connected to the second clean pump unit at the third location and configured to fluidly connect the second clean pump unit to the piping network; and a fourth flow path fluidly connected to the third clean pump unit at the fourth location and configured to fluidly connect the third clean pump unit to the piping network; and a master controller communicatively coupled to the first clean pump unit at the first location and to the slurry pump unit at the second location, wherein the master controller is configured to control an operation of the first clean pump unit and the slurry pump unit.

2. The system of claim 1, wherein the first grid power supply and the second grid power supply provide power in the range from 1,000 kW to 5,000 kW.

3. The system of claim 1, wherein the first grid power supply and the second grid power supply provide power in the range from 2,000 kW to 10,000 kW.

4. The system of claim 1, wherein the first grid power supply, the second grid power supply, the third grid power supply, and the fourth grid power supply provide power transmitted from an infield power generation system located in a region in which the first location, the second location, the third location, and the fourth location are located.

5. The system of claim 1, wherein the first grid power supply, the second grid power supply, the third grid power supply, and the fourth grid power supply provide power transmitted from a remote power generation system located away from a region in which the first location, the second location, the third location, and the fourth location are located.

6. The system of claim 1, wherein the first clean pump unit comprises a plurality of clean pumps, and each clean pump of the plurality of clean pumps of the first clean pump unit receives between 500 hp and 5,000 hp from a prime mover.

7. The system of claim 1, further comprising a blender disposed at the second location, wherein the blender is fluidly coupled to the slurry pump unit.

8. The system of claim 1, wherein the slurry pump unit comprises a plurality of slurry pumps and each slurry pump of the plurality of slurry pumps of the slurry pump unit receives between 500 hp and 5,000 hp from a prime mover.

9. The system of claim 1, wherein the first flow path fluidly connects the piping network to the high pressure manifold at the second location.

10. The system of claim 1, wherein the first flow path fluidly connects the piping network to the wellhead above the well bore at the second location.

11. The system of claim 1, wherein the piping network and the first flow path are configured to provide pressurized fluid in support of a fracturing treatment of the well bore at the second location.

12. The system of claim 1, wherein the piping network forms a loop.

13. A system, comprising:

a first clean pump unit disposed at a first location and coupled to a first clean fluid source;

a first grid power supply disposed at the first location, wherein the first grid power supply provides power in the range from 2,000 kW to 10,000 kW to the first clean pump unit;

a first flow path fluidly connected to the first clean pump unit to output pressurized clean fluid from the first clean pump unit toward a well bore;

a slurry pump unit disposed at a second location, wherein the first location and the second location are 100 yards to 2 miles apart;

a second flow path fluidly connected to the slurry pump unit to output pressurized slurry from the slurry pump unit toward the well bore;

a second grid power supply disposed at the second location, wherein the second grid power supply provides power in the range from 2,000 kW to 10,000 kW to the slurry pump unit;

a second clean pump unit disposed at a third location and coupled to a second clean fluid source;

a third grid power supply disposed at the third location, wherein the third grid power supply provides power in the range from 2,000 kW to 10,000 kW to the second clean pump unit;

a third flow path fluidly connected to the second clean pump unit to output pressurized clean fluid from the second clean pump unit toward the well bore, wherein the third location is 100 yards to 2 miles apart from the first location and 100 yards to 2 miles apart from the second location;

a third clean pump unit disposed at a fourth location and coupled to a third clean fluid source, wherein the fourth location is 100 yards to 2 miles apart from the first location, 100 yards to 2 miles apart from the second location, and 100 yards to 2 miles apart from the third location;

a fourth grid power supply disposed at the fourth location, wherein the third grid power supply provides power in the range from 2,000 kW to 10,000 kW to the third clean pump unit;

a fourth flow path fluidly connected to the third clean pump unit to output pressurized clean fluid from the third clean pump unit toward the well bore; and a master controller communicatively coupled to the first clean pump unit at the first location and to the slurry pump unit at the second location, wherein the master controller is configured to control an operation of the first clean pump unit and the slurry pump unit.

14. The system of claim 13, further comprising a loop piping network, wherein the first flow path connects the first clean pump unit to the loop piping network, wherein the third flow path connects the second clean pump unit to the loop piping network, wherein the fourth flow path connects the third clean pump unit to the loop piping network, and wherein a fifth flow path connects the loop piping network to a wellhead over the well bore or to a high pressure manifold in the second flow path.

15. The system of claim 13, further comprising a centralized hub wherein the first flow path connects the first clean pump unit to the centralized hub, wherein the third flow path connects the second clean pump unit to the centralized hub, wherein the fourth flow path connects the third clean pump unit to the centralized hub, and wherein a fifth flow path connects the centralized hub to a wellhead over the well bore or to a high pressure manifold in the second flow path.

16. The system of claim 13, wherein the first flow path connects the first clean pump unit to the second location, wherein the third flow path connects the second clean pump unit to the second location, and wherein the fourth flow path connects the third clean pump unit to the second location.

17. A method, comprising:

providing a first clean pump unit disposed at a first location;

providing electrical power to the first clean pump unit from a first grid power supply;

providing a second clean pump unit disposed at a second location, wherein the first location and the second location are 100 yards to 2 miles apart;

providing electrical power to the second clean pump unit from a second grid power supply, wherein the second grid power supply is different from the first grid power supply;

providing a third clean pump unit disposed at a third location, wherein the third location is 100 yards to 2 miles from the first location and 100 yards to 2 miles from the second location;

providing electrical power to the third clean pump unit from a third grid power supply, wherein the third grid power supply is different from the first grid power supply and is different from the second grid power supply;

providing a slurry pump unit disposed at a fourth location, wherein the fourth location is 100 yards to 2 miles apart from the first location, 100 yards to 2 miles apart from the second location, and 100 yards to 2 miles apart from the third location, and wherein a well bore is located at the fourth location;

providing electrical power to the slurry pump unit from a fourth grid power supply, wherein the fourth grid power supply is different from the first grid power supply, is different from the second grid power supply, and is different from the third grid power supply;

transporting fluid pressurized by the first clean pump unit, by the second clean pump unit, and by the third clean pump unit toward the well bore via a first flow path;

transporting slurry pressurized by the slurry pump unit toward the well bore via a second flow path; and controlling the first clean pump unit, the second clean pump unit, the third clean pump unit, and the slurry pump unit using a master controller, wherein the master controller is communicatively coupled to the first clean pump unit at the first location, the second clean pump unit at the second location, the third clean pump unit at the third location, and the slurry pump unit at the fourth location.

18. The method of claim 17, wherein the first flow path comprises a bidirectional loop piping network.

19. The method of claim 17, wherein the first grid power supply, the second grid power supply, the third grid power supply, and the fourth grid power supply provide power transmitted from an infield power generation system located in a region in which the first location, the second location, the third location, and the fourth location are located.

20. The method of claim 17, wherein the first grid power supply, the second grid power supply, the third grid power supply, and the fourth grid power supply provide power transmitted from a remote power generation system located away from a region in which the first location, the second location, the third location, and the fourth location are located.

* * * * *